US005794186A

United States Patent [19]

Bergstrom et al.

[11] Patent Number: 5,794,186

[45] Date of Patent: Aug. 11, 1998

[54] METHOD AND APPARATUS FOR ENCODING SPEECH EXCITATION WAVEFORMS THROUGH ANALYSIS OF DERIVATIVE DISCONTINUES

[75] Inventors: Chad Scott Bergstrom, Chandler; Bruce Alan Fette, Mesa; Cynthia Ann Jaskie, Scottsdale; Clifford Wood, Tempe; Sean Sungsoo You, Chandler, all of Ariz.

[73] Assignee: Motorola, Inc., Schaumburg, Ill.

[21] Appl. No.: 713,620

[22] Filed: Sep. 13, 1996

Related U.S. Application Data

[62] Division of Ser. No. 349,638, Dec. 5, 1994.

[51] Int. Cl.[6] ..... G10L 9/00; G10L 3/02

[52] U.S. Cl. ..... 704/223; 704/219

[58] Field of Search ..... 395/2.16, 2.17, 395/2.18, 2.19, 2.2, 2.23, 2.24, 2.32

[56] References Cited

U.S. PATENT DOCUMENTS 5,602,959 2/1997 Bergstrom et al. ..... 395/2.14

*Primary Examiner*—David R. Hudspeth

*Assistant Examiner*—Susan Wieland

*Attorney, Agent, or Firm*—Sherry J. Whitney

[57] ABSTRACT

A vocoder device and corresponding method characterizes and reconstructs speech excitation. An excitation analysis portion performs a cyclic excitation transformation process on a target excitation segment by rotating a peak amplitude to a beginning buffer location. The excitation phase representation is dealiased using multiple dealiasing passes based on the phase slope variance. Both primary and secondary excitation components are characterized, where the secondary excitation is characterized based on a computation of the error between the characterized primary excitation and the original excitation. Alternatively, an excitation pulse compression filter is applied to the target, resulting in a symmetric target. The symmetric target is characterized by normalizing half the symmetric target. The synthesis portion performs reconstruction and synthesis of the characterized excitation based on the characterization method employed by the analysis portion.

7 Claims, 17 Drawing Sheets

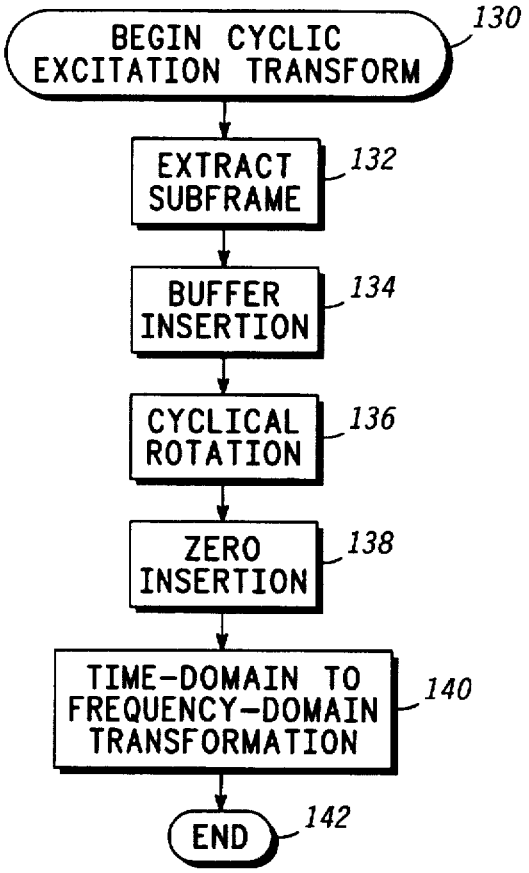
FIG. 3
FIG. 11
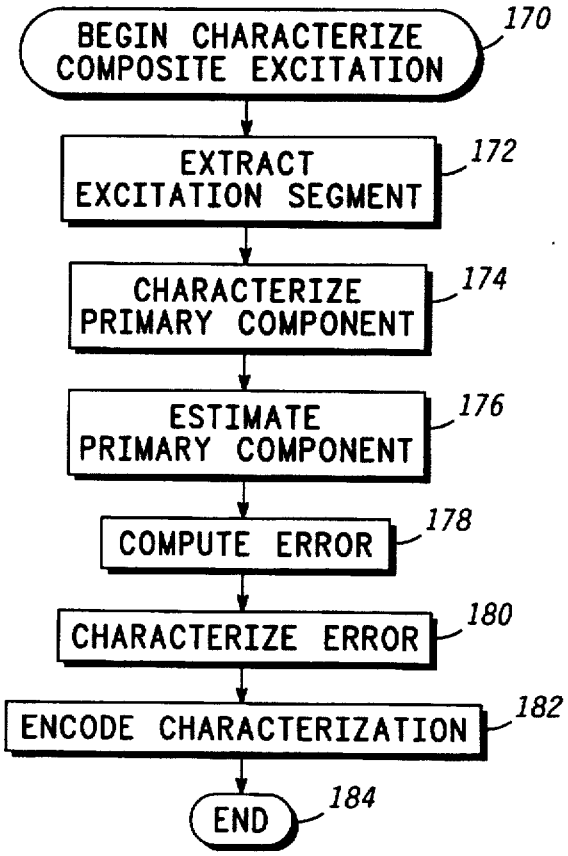

METHOD AND APPARATUS FOR ENCODING SPEECH EXCITATION WAVEFORMS THROUGH ANALYSIS OF DERIVATIVE DISCONTINUES

CROSS-REFERENCE TO RELATED APPLICATIONS

This is a division of application Ser. No. 08/349,638, filed Dec. 5, 1994. This application is related to co-pending U.S. patent application Ser. No. 08/349,752, filed on Dec. 5, 1994, entitled "Method and Apparatus for Parameterization of Speech Excitation Waveforms", Ser. No. 08/349,639, filed on Dec. 5, 1994, entitled "Method and Apparatus for Synthesis of Speech Excitation Waveforms", and U.S. Pat. Nos. 5,504,834, entitled "Pitch Epoch Synchronous Linear Predictive Coding Vocoder and Method", and 5,479,559, entitled "Excitation Synchronous Time Encoding Vocoder and Method". All patents and patent applications are assigned to the same assignee as the present application.

FIELD OF THE INVENTION

The present invention relates generally to the field of encoding and decoding signals having periodic components and, more particularly, to techniques and devices for digitally encoding and decoding speech waveforms.

BACKGROUND OF THE INVENTION

Voice coders, referred to commonly as "vocoders", compress and decompress speech data. Vocoders allow a digital communication system to increase the number of system communication channels by decreasing the bandwidth allocated to each channel. Fundamentally, a vocoder implements specialized signal processing techniques to analyze or compress speech data at an analysis device and synthesize or decompress the speech data at a synthesis device. Speech data compression typically involves parametric analysis techniques, whereby the fundamental or "basis" elements of the speech signal are extracted. Speech basis elements include the excitation waveform structure, and parametric components of the excitation waveform, such as voicing modes, pitch, and excitation epoch positions. These extracted basis elements are encoded and sent to the synthesis device in order to provide for reduction in the amount of transmitted or stored data. At the synthesis device, the basis elements may be used to reconstruct an approximation of the original speech signal. Because the synthesized speech is typically in inexact approximation derived from the basis elements, a listener at the synthesis device may detect voice quality which is inferior to the original speech signal. This is particularly true for vocoders that compress the speech signal to low bit rates, where less information about the original speech signal may be transmitted or stored.

A number of voice coding methodologies extract the speech basis elements by using a linear predictive coding (LPC) analysis of speech, resulting in prediction coefficients that describe an all-pole vocal tract transfer function. LPC analysis generates an "excitation" waveform that represents the driving function of the transfer function. Ideally, if the LPC coefficients and the excitation waveform could be transmitted to the synthesis device exactly, the excitation waveform could be used as a driving function for the vocal tract transfer function, exactly reproducing the input speech. In practice, however, the bit-rate limitations of a communication system will not allow for complete transmission of the excitation waveform.

Prior-art frequency domain characterization methods exist which exploit the impulse-like characteristics of pitch synchronous excitation segments (i.e., epochs). However, prior-art methods are unable to overcome the effects of steep spectral phase slope and phase slope variance which introduces quantization error in synthesized speech. Furthermore, removal of phase ambiguities (i.e., dealiasing) is critical prior to spectral characterization. Failure to remove phase ambiguities can lead to poor excitation reconstruction. Prior-art dealiasing procedures (e.g., modulo 2-pi dealiasing) often fail to fully resolve phase ambiguities in that they fail to remove many aliasing effects that distort the phase envelope, especially in steep phase slope conditions.

Epoch synchronous excitation waveform segments often contain both "primary" and "secondary" excitation components. In a low-rate voice coding structure, complete characterization of both components ultimately enhances the quality of the synthesized speech. Prior-art methods adequately characterize the primary component, but typically fail to accurately characterize the secondary excitation component. Often these prior-art methods decimate the spectral components in a manner that ignores or aliases those components that result from secondary excitation. Such methods are unable to fully characterize the nature of the secondary excitation components.

After characterization and transmission or storage of excitation basis elements, excitation waveform estimates must be accurately reconstructed to ensure high-quality synthesized speech. Prior-art frequency-domain methods use discontinuous linear piecewise reconstruction techniques which occasionally introduce noticeable distortion of certain epochs. Interpolation using these epochs produces a poor estimate of the original excitation waveform.

Low-rate speech coding methods that implement frequency domain epoch synchronous excitation characterization often employ a significant number of bits for characterization of the group delay envelope. Since the epoch synchronous group delay envelope conveys less perceptual information than the magnitude envelope, such methods can benefit from characterizing the group delay envelope at low resolution, or not at all for very low rate applications. In this manner the required bit rate is reduced, while maintaining natural-sounding synthesized speech. As such, reasonably high-quality speech can be synthesized directly from excitation epochs exhibiting zero epoch synchronous spectral group delay. Specific signal conditioning procedures may be applied in either the time or frequency domain to achieve zero epoch synchronous spectral group delay. Frequency domain methods can null the group delay waveform by means of forward and inverse Fourier transforms. Preferred methods use efficient time-domain excitation group delay removal procedures at the analysis device, resulting in zero group delay excitation epochs. Such excitation epochs possess symmetric qualities that can be efficiently encoded in the time domain, eliminating the need for computationally intensive frequency domain transformations. In order to enhance speech quality, an artificial or preselected excitation group delay characteristic can optionally be introduced via filtering at the synthesis device after reconstruction of the characterized excitation segment. Hence, prior-art methods fail to remove the excitation group delay on an epoch synchronous basis. Additionally, prior-art methods often use frequency-domain characterization methods (e.g., Fourier transforms) which are computationally intensive.

Accurate characterization and reconstruction of the excitation waveform is difficult to achieve at low bit rates. At low bit rates, typical excitation-based vocoders that use time or frequency-domain modeling do not overcome the limitations detailed above, and hence cannot synthesize high quality speech.

Global trends toward complex, high-capacity telecommunications emphasize a growing need for high-quality speech coding techniques that require less bandwidth. Near-future telecommunications networks will continue to demand very high-quality voice communications at the lowest possible bit rates. Military applications, such as cockpit communications and mobile radios, demand higher levels of voice quality. In order to produce high-quality speech, limited-bandwidth systems must be able to accurately reconstruct the salient waveform features after transmission or storage. Hence, what are needed are a method and apparatus for characterization and reconstruction of the speech excitation waveform that achieves high-quality speech after reconstruction.

Particularly, what are needed are a method and apparatus to minimize spectral phase slope and spectral phase slope variance. What are further needed are a method and apparatus to remove phase ambiguities prior to spectral characterization while maintaining the overall phase envelope. What are further needed are a method and apparatus to accurately characterize both primary and secondary excitation components so as to preserve the full characteristics of the original excitation. What are further needed are a method and apparatus to recreate a more natural, continuous estimate of the original frequency-domain envelope that avoids distortion associated with piecewise reconstruction techniques. What are further needed are a method and apparatus to remove the group delay on an epoch synchronous basis in order to maintain synthesized speech quality, simplify computation, and reduce the required bit rate. The method and apparatus needed further simplify computation by using a time-domain symmetric characterization method which avoids the computational complexity of frequency-domain operations. The method and apparatus needed optionally apply artificial or preselected group delay filtering to further enhance synthesized speech quality.

BRIEF DESCRIPTION OF THE DRAWINGS

FIG. 3 illustrates a flow chart of a method for cyclic excitation transformation in accordance with a preferred embodiment of the present invention;

FIG. 11 illustrates a flow chart of a method for characterizing the composite excitation in accordance with a preferred embodiment of the present invention;

DETAILED DESCRIPTION OF THE DRAWINGS

The present invention provides an accurate excitation waveform characterization and reconstruction technique and apparatus that result in higher quality speech at lower bit rates than is possible with prior-art methods. Generally, the present invention introduces a new and improved excitation characterization and reconstruction method and apparatus that serve to maintain high voice quality when used in an appropriate excitation-based vocoder architecture. This method is applicable for implementation in new and existing voice coding platforms that require efficient, accurate excitation modeling algorithms. In such platforms, accurate modeling of the LPC-derived excitation waveform is essential in order to reproduce high quality speech at low bit rates.

One advantage to the present invention is that it minimizes spectral phase slope and spectral phase slope variance in an epoch-synchronous excitation characterization methodology. The method and apparatus remove phase ambiguities prior to spectral characterization while maintaining the overall phase envelope. The method and apparatus also accurately characterize both primary and secondary components so as to preserve the full characteristics of the original excitation. Additionally, the method and apparatus recreate a more natural, continuous estimate of the original, frequency-domain envelope which avoids distortion associated with prior-art linear piecewise reconstruction techniques. Further, the method and apparatus remove spectral group delay on an epoch synchronous basis in a manner that preserves speech quality, simplifies computation, and results in reduced bit rates. The method and apparatus further simplify computation by using a time-domain characterization method which avoids the computational complexity of frequency-domain operations. Additionally, the method and apparatus provide for optional application of artificial or preselected group delay filtering to further enhance synthesized speech quality.

In a preferred embodiment of the present invention, the vocoder apparatus desirably includes an analysis function that performs parameterization and characterization of the LPC-derived speech excitation waveform, and a synthesis function that performs reconstruction and speech synthesis of the parameterized excitation waveform. In the analysis function, basis excitation waveform elements are extracted from the LPC-derived excitation waveform by using the characterization method of the present invention. This results in parameters that accurately describe the LPC-derived excitation waveform at a significantly reduced bit-rate. In the synthesis function, these parameters may be used to reconstruct an accurate estimate of the excitation waveform, which may subsequently be used to generate a high-quality estimate of the original speech.

A. Improved Vocoder Apparatus

Figure 1:
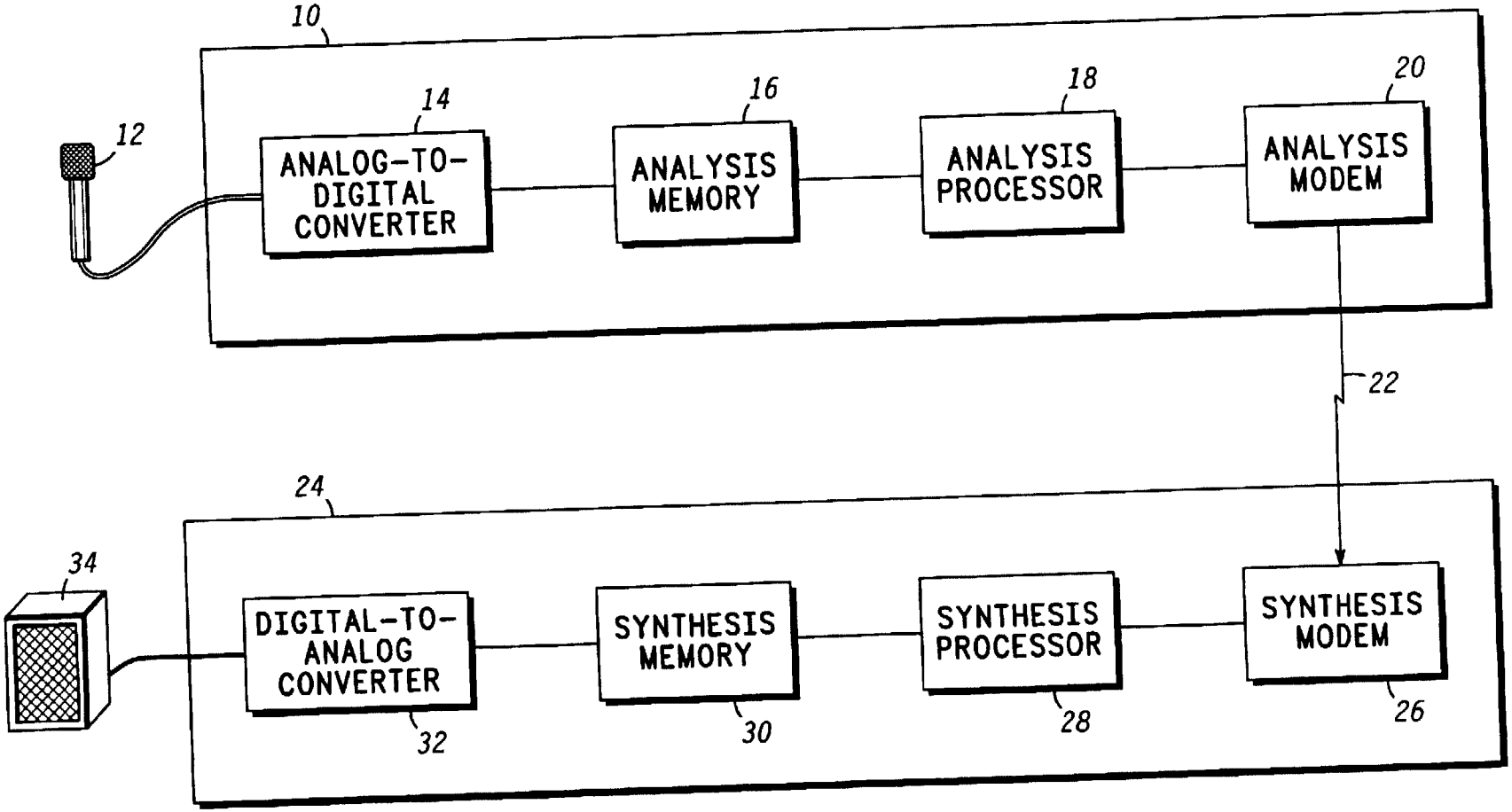
FIG. 1 shows an illustrative vocoder apparatus in accordance with a preferred embodiment of the present invention.

FIG. 1 shows an illustrative vocoder apparatus in accordance with a preferred embodiment of the present invention. The vocoder apparatus comprises a vocoder analysis device 10 and a vocoder synthesis device 24. Vocoder analysis device 10 comprises analog-to-digital converter 14, analysis memory 16, analysis processor 18, and analysis modem 20. Microphone 12 is coupled to analog-to-digital converter 14 which converts analog voice signals from microphone 12 into digitized speech samples. Analog-to-digital converter 14 may be, for example, a 32044 codec available from Texas Instruments of Dallas, Tex. In a preferred embodiment, analog-to-digital converter 14 is coupled to analysis memory device 16. Analysis memory device 16 is coupled to analysis processor 18. In an alternate embodiment, analog-to-digital converter 14 is coupled directly to analysis processor 18. Analysis processor 18 may be, for example, a digital signal processor such as a DSP56001, DSP56002, DSP96002 or DSP56166 integrated circuit available from Motorola, Inc. of Schaumburg, Ill.

In a preferred embodiment, analog-to-digital converter 14 produces digitized speech samples that are stored in analysis memory device 16. Analysis processor 18 extracts the sampled, digitized speech data from the analysis memory device 16. In an alternate embodiment, sampled, digitized speech data is stored directly in the memory or registers of analysis processor 18, thus eliminating the need for analysis memory device 16.

In a preferred embodiment, analysis processor 18 performs the functions of analysis pre-processing, excitation segment selection, excitation weighting, cyclic excitation transformation, excitation phase dealiasing, composite excitation characterization, and analysis post-processing. In an alternate embodiment, analysis processor 18 performs the functions of analysis pre-processing, excitation segment selection, excitation weighting, excitation pulse compression, symmetric excitation characterization, and analysis post-processing. Analysis processor 18 also desirably includes functions of encoding the characterizing data using scalar quantization, vector quantization (VQ), split vector quantization, or multi-stage vector quantization codebooks. Analysis processor 18 thus produces an encoded bitstream of compressed speech data.

Analysis processor 18 is coupled to analysis modem 20 which accepts the encoded bitstream and prepares the bitstream for transmission using modulation techniques commonly known to those of skill in the art. Analysis modem 20 may be, for example, a V.32 modem available from Universal Data Systems of Huntsville, Alabama. Analysis modem 20 is coupled to communication channel 22, which may be any communication medium, such as fiber-optic cable, coaxial cable or a radio-frequency (RF) link. Other media may also be used as would be obvious to those of skill in the art based on the description herein.

Vocoder synthesis device 24 comprises synthesis modem 26, synthesis processor 28, synthesis memory 30, and digital-to-analog converter 32. Synthesis modem 26 is coupled to communication channel 22. Synthesis modem 26 accepts and demodulates the received, modulated bitstream. Synthesis modem 26 may be, for example, a V.32 modem available from Universal Data Systems of Huntsville, Ala.

Synthesis modem 26 is coupled to synthesis processor 28. Synthesis processor 28 performs the decoding and synthesis of speech. Synthesis processor 28 may be, for example, a digital signal processor such as a DSP56001, DSP56002, DSP96002 or DSP56166 integrated circuits available from Motorola, Inc. of Schaumburg, Ill.

In a preferred embodiment, synthesis processor 28 performs the functions of synthesis pre-processing, desirably including decoding steps of scalar, vector, split vector, or multi-stage vector quantization codebooks. Additionally, synthesis processor 28 performs nonlinear spectral excitation epoch reconstruction, composite excitation reconstruction, speech synthesis, and synthesis post processing. In an alternate embodiment, synthesis processor 28 performs symmetric excitation reconstruction, additive group delay filtering, speech synthesis, and synthesis post-processing In a preferred embodiment, synthesis processor 28 is coupled to synthesis memory device 30. In an alternate embodiment, synthesis processor 28 is coupled directly to digital-to-analog converter 32. Synthesis processor 28 stores the digitized, synthesized speech in synthesis memory device 30. Synthesis memory device 30 is coupled to digital-to-analog converter 32 which may be, for example, a 32044 codec available from Texas Instruments of Dallas, Tex. Digital-to-analog converter 32 converts the digitized, synthesized speech into an analog waveform appropriate for output to a speaker or other suitable output device 34.

For clarity and ease of understanding, FIG. 1 illustrates analysis device 10 and synthesis device 24 in separate physical devices. This configuration would provide simplex communication (i.e., communication in one direction only). Those of skill in the art would understand based on the description that an analysis device 10 and synthesis device 24 may be located in the same unit to provide half-duplex or full-duplex operation (i.e., communication in both the transmit and receive directions).

In an alternate embodiment, one or more processors may perform the functions of both analysis processor 18 and synthesis processor 28 without transmitting the encoded bitstream. The analysis processor would calculate the encoded bitstream and store the bitstream in a memory device. The synthesis processor could then retrieve the encoded bitstream from the memory device and perform synthesis functions, thus creating synthesized speech. The analysis processor and the synthesis processor may be a single processor as would be obvious to one of skill in the art based on the description. In the alternate embodiment, modems (e.g., analysis modem 20 and synthesis modem 26) would not be required to implement the present invention.

B. Speech Excitation Analysis Method

Figure 2:
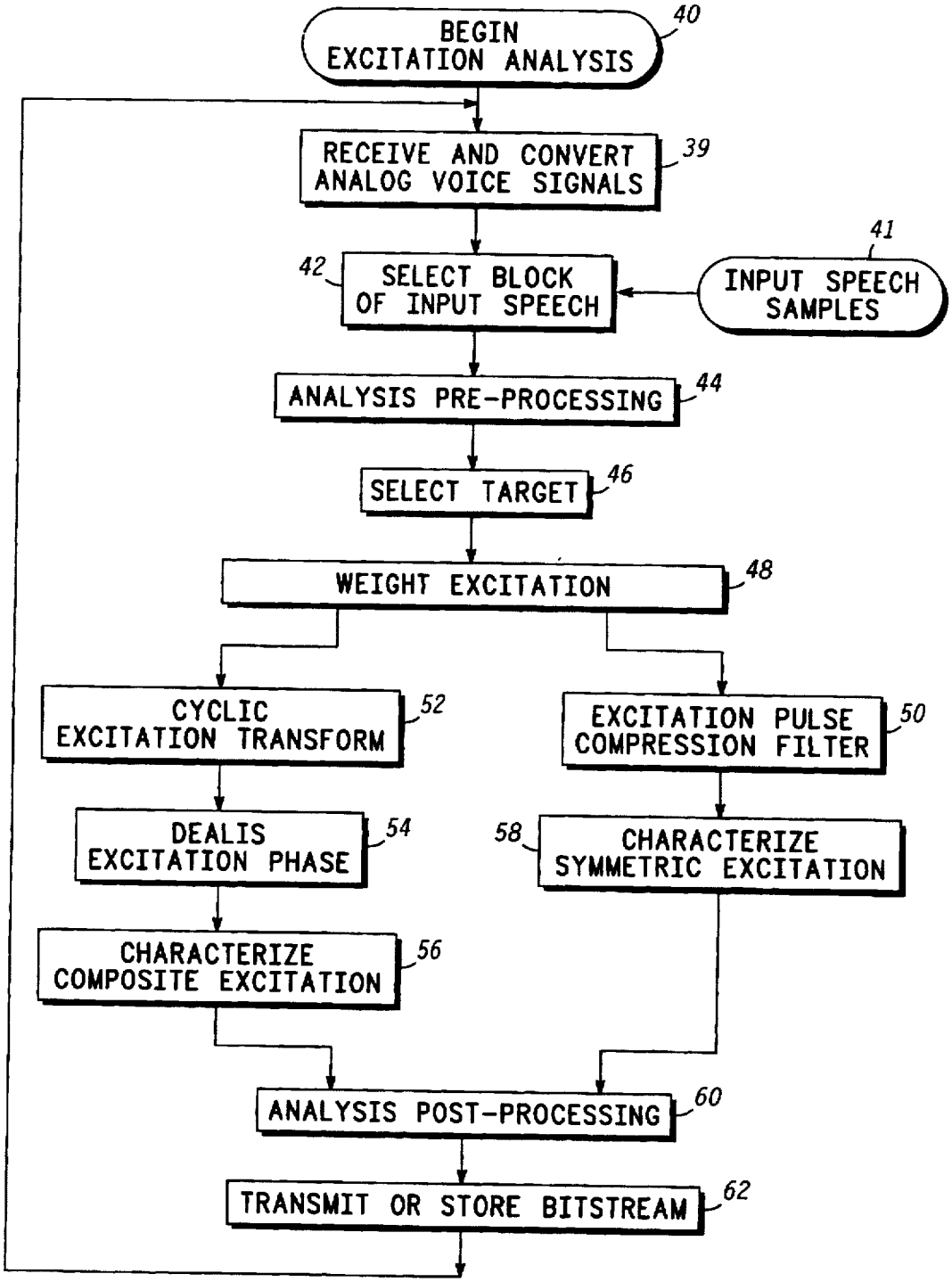
FIG. 2 illustrates a flow chart of a method for speech excitation analysis in accordance with a preferred embodiment of the present invention.

FIG. 2 illustrates a flowchart of a method for speech excitation analysis for voiced speech in accordance with a preferred embodiment of the invention. Unvoiced speech can be processed, for example, by companion methods which characterize the envelope of the unvoiced excitation segments at the analysis device, and reconstruct the unvoiced segments at the synthesis device by amplitude modulation of pseudo-random data. The excitation analysis process is carried out by analysis processor 18 (FIG. 1). The Excitation Analysis process begins in step 40 (FIG. 2) in step 39, when analog voice signals are received and converted to digitized speech samples. Next, the method performs Select Block of Input Speech step 42 which selects a finite number of digitized speech samples 41 for processing. This finite number of digitized speech samples will be referred to herein as an analysis block.

Next, the Analysis Pre-Processing step 44 performs high pass filtering, spectral slope removal, and linear prediction coding (LPC) on the digitized speech samples. These processes are well known to those skilled in the art. The result of the Analysis Pre-Processing step 44 is an LPC-derived excitation waveform, LPC coefficients, pitch, voicing, and excitation epoch positions. Excitation epoch positions correspond to sample numbers within the analysis block where excitation epochs are located.

Typical pitch synchronous analysis includes characterization and coding of a single excitation epoch, or target, extracted from the excitation waveform. The Select Target step 46 selects a target within the analysis block for characterization. The Select Target step 46 desirably uses a closed-loop method of target selection which minimizes frame-to-frame interpolation error.

The Weight Excitation step 48 applies a weighting function (e.g., adaptive with sinusoidal roll-off or Hamming window) to the selected target prior to characterization. The Weight Excitation step 48, which effectively smoothes the spectral envelope prior to the decimating characterization process, is optional for the alternate compression filter embodiment.

In a preferred embodiment, the Cyclic Excitation Transformation process 52 performs a transform operation on the weighted optimum excitation segment in order to minimize spectral phase slope and reduce spectral phase slope variance prior to the frequency-domain characterization process. The Cyclic Excitation Transformation process 52 results in spectral magnitude and phase waveforms corresponding to the excitation segment under consideration. The Cyclic Excitation Transformation process 52 is described in more detail in conjunction with FIG. 3.

Then, the Dealias Excitation Phase process 54 is performed which removes remnant phase aliasing after implementation of common dealiasing methods. The Dealias Excitation Phase process 54 produces a phase waveform with a minimum number of modulo-2Pi discontinuities. The Dealias Excitation Phase process 54 is described in more detail in conjunction with FIG. 6.

After the Dealias Excitation Phase process 54, the Characterize Composite Excitation process 56 uses the dealiased spectral phase waveform and the spectral magnitude waveform to characterize the existing primary and secondary spectral excitation components. This process results in decimated envelope estimates of the primary phase waveform, the secondary phase waveform, the primary magnitude waveform, and the secondary magnitude waveform. The Characterize Composite Excitation process 56 is described in more detail in conjunction with FIG. 11.

In an alternate embodiment, the Excitation Pulse Compression Filter process 50 and the Characterize Symmetric Excitation process 58 are substituted for the Cyclic Excitation Transformation process 52, the Dealias Excitation Phase process 54, and the Characterize Composite Excitation process 56. The Excitation Pulse Compression Filter process 50 is described in more detail in conjunction with FIG. 16. Characterize Symmetric Excitation process 58 is described in more detail in conjunction with FIG. 20.

The Analysis Post-Processing step 60 is then performed which includes coding steps of scalar quantization, VQ, and split-vector quantization, or multi-stage vector quantization of the excitation parameters. These methods are well known to those of skill in the art. In a preferred embodiment, in addition to codebook indices corresponding to parameters such as pitch, voicing, LPC spectral information, waveform energy, and optional target location, the result of the Analysis Post-Processing step 60 includes codebook indices corresponding to the decimated magnitude and phase waveforms. In an alternate embodiment, the result of the Analysis Post-Processing step 60 includes codebook indices corresponding to the Characterize Symmetric Excitation step 58. In general, such codebook indices map to the closest match between the characterized waveforms and extracted parameter estimates, and the corresponding waveforms and parameters selected from predefined waveform and parameter families.

The Transmit or Store Bitstream step 62 produces a bitstream (including codebook indices) and either stores the bitstream to a memory device or transmits it to a modem (e.g., transmitter modem 20, FIG. 1) for modulation.

The Excitation Analysis procedure then performs the Select Input Speech Block step 42, and the procedure iterates as shown in FIG. 2.

1. Cyclic Excitation Transformation

Excitation waveform characterization is enhanced by special time-domain pre-processing techniques which positively impact the spectral representation of the data. Often, it is beneficial to analyze a segment or epoch of the excitation waveform that is synchronous to the fundamental voice pitch period. Epoch synchronous analysis eliminates pitch harmonics from the spectral representations, producing magnitude and phase waveforms that can be efficiently characterized for transmission. Prior-art frequency-domain characterization methods have been developed which exploit the impulse-like spectral characteristics of these synchronous excitation segments.

The Cyclic Excitation Transformation process 52 (FIG. 2) minimizes spectral phase slope, which reduces phase aliasing problems. The Cyclic Excitation Transformation process 52 (FIG. 2) also minimizes spectral phase slope variance for epoch-synchronous analysis methods which is of benefit for voice coding applications which utilize efficient vector quantization techniques. Voice coding platforms which utilize spectral representations of pitch-synchronous excitation will benefit from the pre-processing technique of the Cyclic Excitation Transformation process 52 (FIG. 2). FIG. 3 illustrates a flowchart of the Cyclic Excitation Transformation process 52 (FIG. 2) in accordance with a preferred embodiment of the invention.

Figure 4:
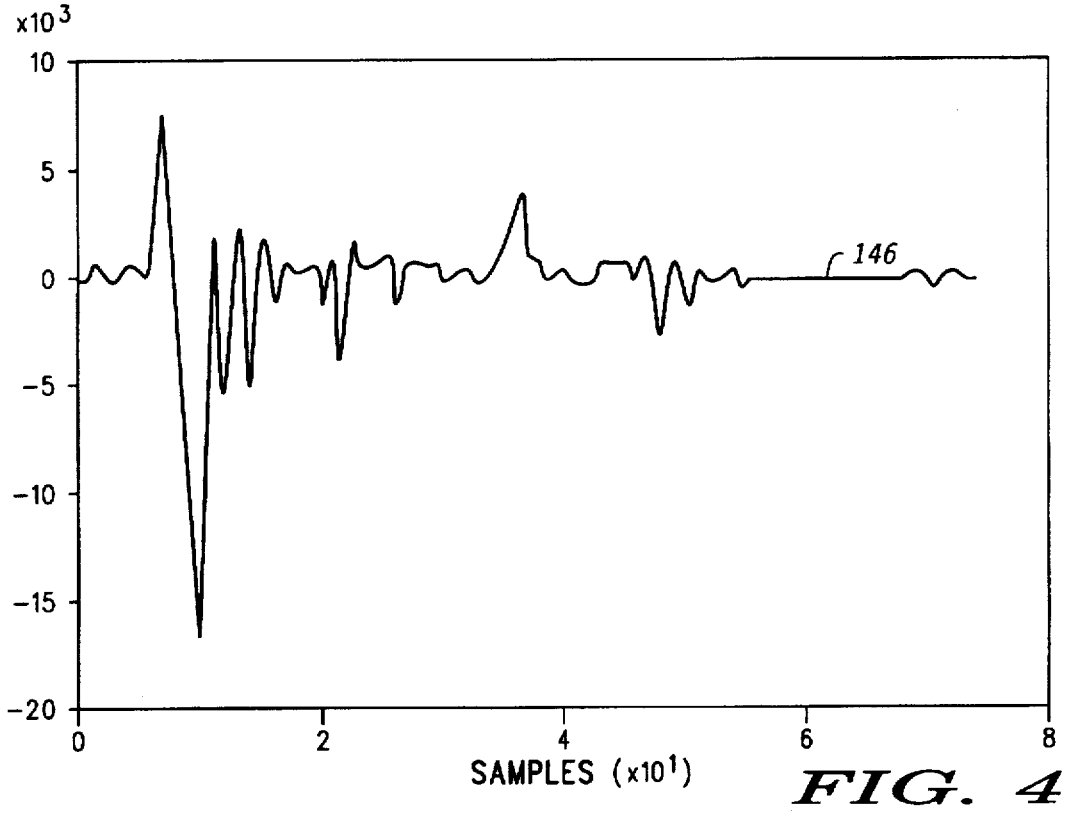
FIG. 4 shows an example of a speech excitation epoch.

The Cyclic Excitation Transformation process begins in step 130 by performing the Extract Subframe step 132. The Extract Subframe step 132 extracts an M-sample excitation segment. In a preferred embodiment, the extracted subframe will be synchronous to the pitch (e.g., the subframe will contain an epoch). FIG. 4 shows an example of a speech excitation epoch 146 which may represent an extracted subframe.

Next, the Buffer Insertion step 134 places the M-sample extracted excitation segment into an N-sample buffer, where desirably N is greater than or equal to M and the range of cells in the buffer is from 0 to N−1.

Next, the Cyclical Rotation step 136 cyclically shifts the M-sample excitation segment in the array, placing the peak amplitude of the excitation in a beginning buffer location in the N sample buffer. The Cyclical Rotation step 136 cyclically shifts the excitation that was originally left of the peak to the end of the N sample buffer. Thus, the sample originally just left of the peak is placed in buffer index N−1, the sample originally two samples left of the peak in N−2, and so on.

The Zero Insertion step 138 then places zeroes in the remaining locations of the N sample buffer.

Next, the Time-Domain to Frequency-Domain Transformation step 140 generates a spectral representation of the shifted samples by transforming the samples in the N-sample buffer into the frequency domain. In a preferred embodiment, the Time-Domain to Frequency-Domain Transformation step 140 is performed using an N-sample FFT.

Figure 5:
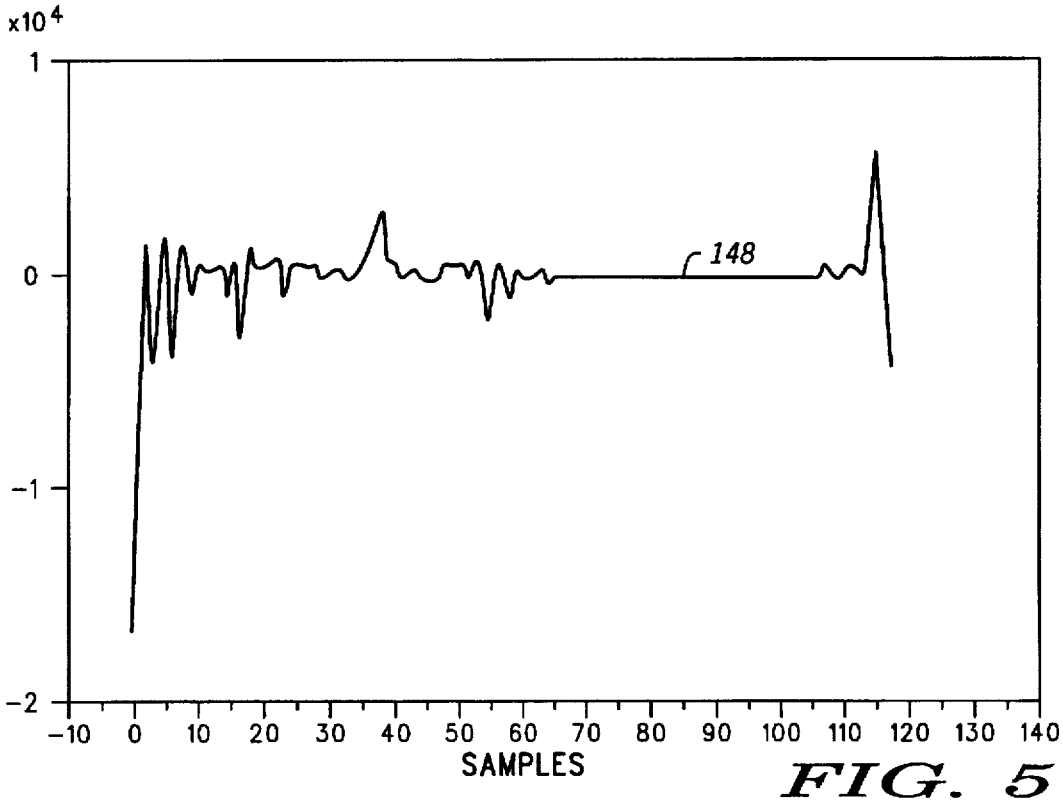
FIG. 5 shows an example of a typical speech excitation epoch after cyclic rotation performed in accordance with a preferred embodiment of the present invention.

The Cyclic Excitation Transformation process then exits in step 142. FIG. 5 shows an example of a typical speech excitation epoch 148 after cyclic rotation performed in accordance with a preferred embodiment of the present invention.

2. Dealias Excitation Phase

Given the envelope-preserving nature of low-rate spectral characterization methods, removal of phase ambiguities is critical prior to spectral characterization. Failure to fully remove phase ambiguities can lead to poor reconstruction of the representative excitation segment. As a result, interpolating voice coding schemes may not accurately maintain the character of the original excitation waveform.

Using common dealiasing procedures, further processing is necessary in cases where these procedures fail to fully resolve phase ambiguities. Specifically, simple modulo-2Pi mitigation techniques are effective in removing a number of phase ambiguities, but often fail to remove many aliasing effects that distort the phase envelope. Regarding typical spectral representation of excitation epochs, simple phase dealiasing techniques can fail to resolve steep-slope aliasing.

The application of spectral characterization methods to aliased waveforms can destroy the original envelope characteristics of the phase and can introduce distortion in the reconstructed excitation. The Dealias Excitation Phase process 54 (FIG. 2) eliminates the aliasing resulting from common modulo-2Pi methods and maintains the overall phase envelope.

Figure 6:
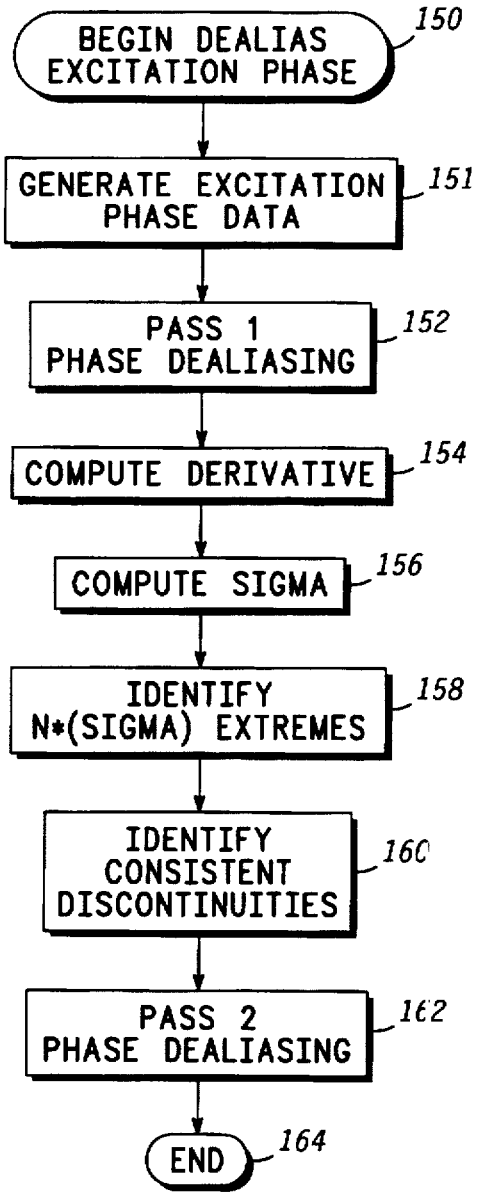
FIG. 6 illustrates a flow chart of a method for dealiasing the excitation phase in accordance with a preferred embodiment of the present invention.
Figure 7:
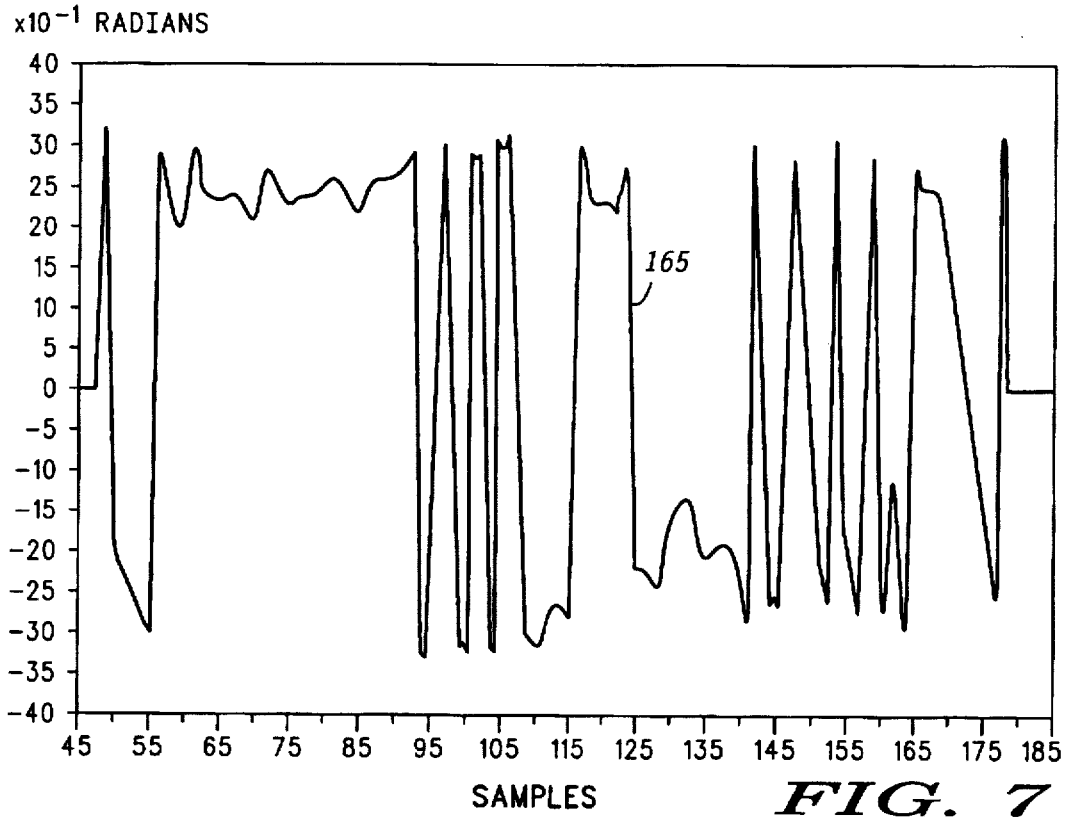
FIG. 7 shows an example of a phase representation having ambiguities.
Figure 8:
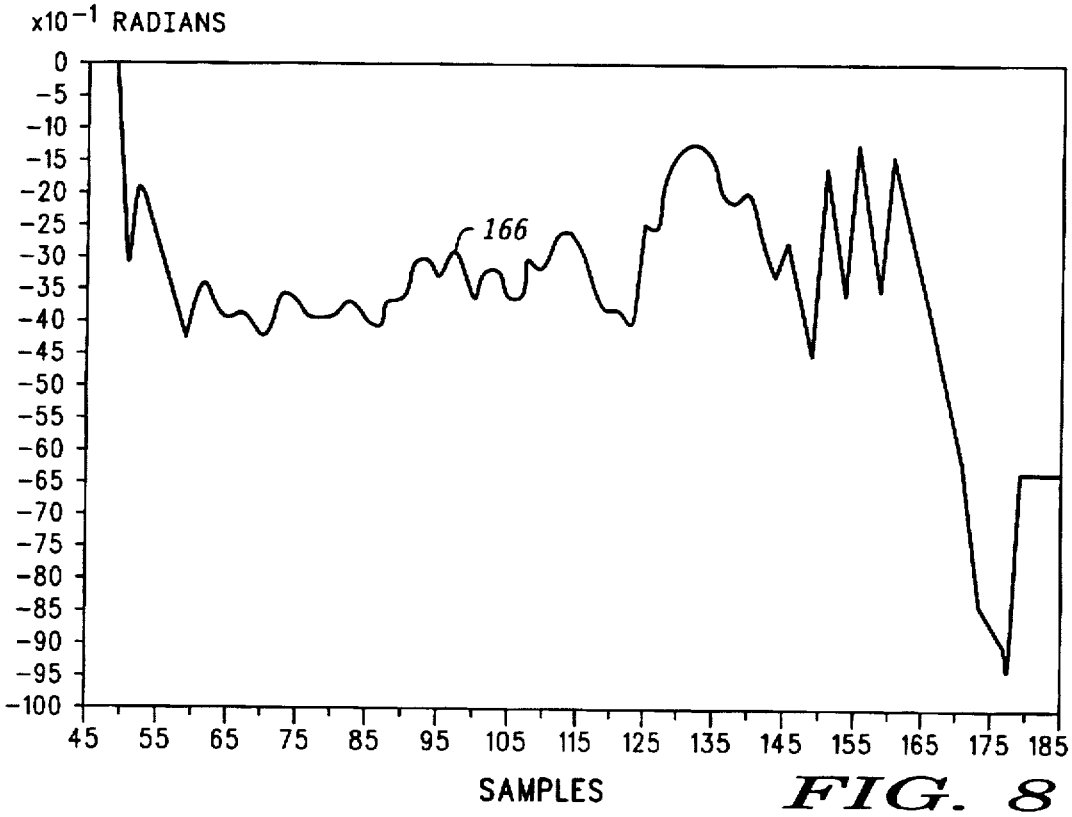
FIG. 8 shows an example of a dealiased phase representation calculated in accordance with prior-art modulo 2-pi methods.

FIG. 6 illustrates a flowchart of the Dealias Excitation Phase process 54 (FIG. 2) in accordance with a preferred embodiment of the invention. The Dealias Excitation Phase process begins in step 150 by performing the Generate Excitation Phase Data step 151. Excitation phase data is generated, for example, from a Fourier transform operation. The method continues by performing the Pass 1 Phase Dealiasing step 152. The Pass 1 Phase Dealiasing step 152 implements modulo-2Pi dealiasing which will be familiar to those skilled in the art. FIG. 7 shows an example of a phase representation 165 having ambiguities. FIG. 8 shows an example of a dealiased phase representation 166 calculated in accordance with prior-art modulo 2-pi methods.

Figure 9:
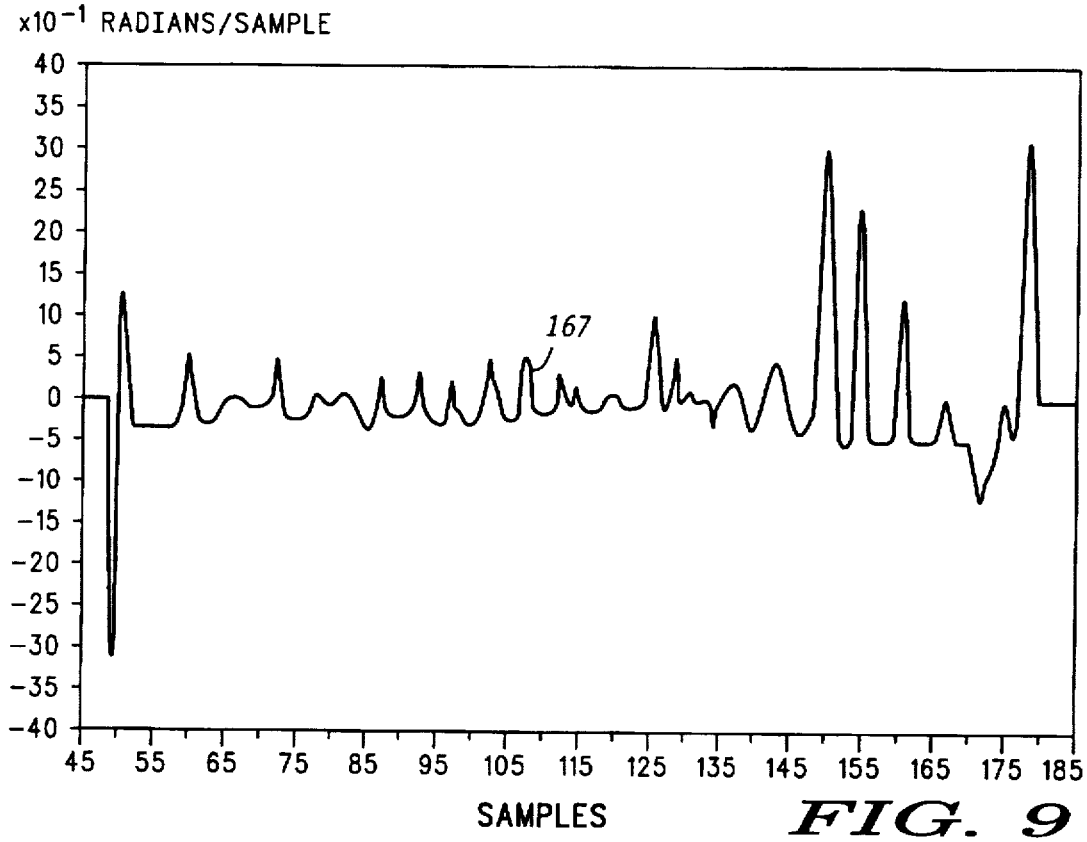
FIG. 9 shows an example of an excitation phase derivative calculated in accordance with a preferred embodiment of the present invention.

Next, the Compute Derivative step 154 computes the one-sample derivative of the result of the Pass 1 Phase Dealiasing step 152. FIG. 9 shows an example of an excitation phase derivative 167 calculated in accordance with a preferred embodiment of the present invention.

After the Compute Derivative step 154, the Compute Sigma step 156 is performed. The Compute Sigma step 156 computes the standard deviation (Sigma) of the one-sample derivative. Sigma, or a multiple thereof, is desirably used as a predetermined deviation error, although other measurements may be used as would be obvious to one of skill in the art based on the description.

Next, the Identify (N×Sigma) Extremes step 158 identifies discontinuity samples having derivative values exceeding (N×Sigma), where N is an apriori determined factor. These significant excursions from Sigma are interpreted as possible aliased phase.

Next the Identify Consistent Discontinuities step 160 determines whether each of the discontinuity samples is consistent or inconsistent with the overall phase-slope direction of the pass-i dealiased phase. This may be accomplished by comparing the phase slope of the discontinuity sample with the phase slope of preceding or following samples. Given apriori knowledge of the phase behavior of excitation epochs, if the second derivative exceeds the standard deviation by a significant amount (e. g., (4×Sigma)), and if the overall slope direction will be preserved, then an additional phase correction should be performed at the discontinuity.

Thus, the Pass 2 Phase Dealiasing step 162 performs an additional dealias step at the discontinuity samples when the dealias step will serve to preserve the overall phase slope. This results in twice-dealiased data at some phase sample positions. The result of the Pass 2 Phase Dealiasing step 162 is to remove the largest ambiguities remaining in the phase waveform, allowing for characterization of the overall envelope without significant distortion.

Figure 10:
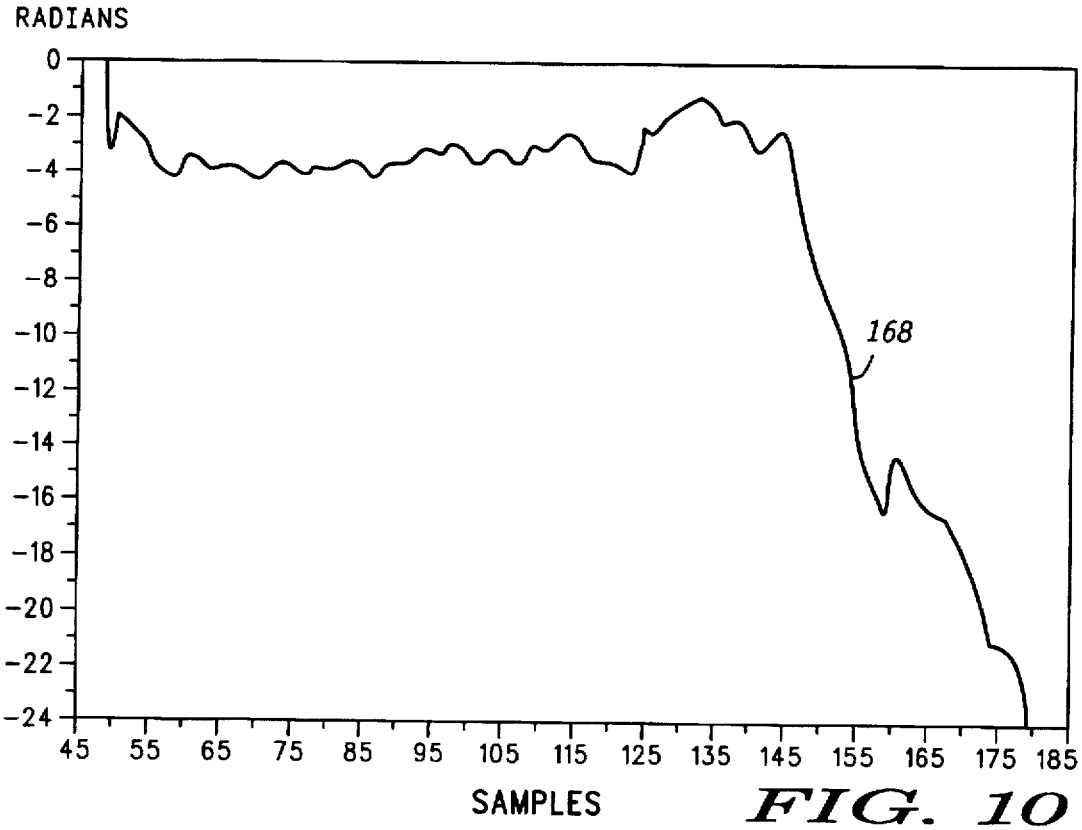
FIG. 10 shows an example of a dealiased phase representation calculated in accordance with a preferred embodiment of the present invention.

The Dealias Excitation phase process then exits in step 164. FIG. 10 shows an example of a dealiased phase representation 168 calculated in accordance with a preferred embodiment of the present invention.

3. Characterize Composite Excitation

Figure 12:
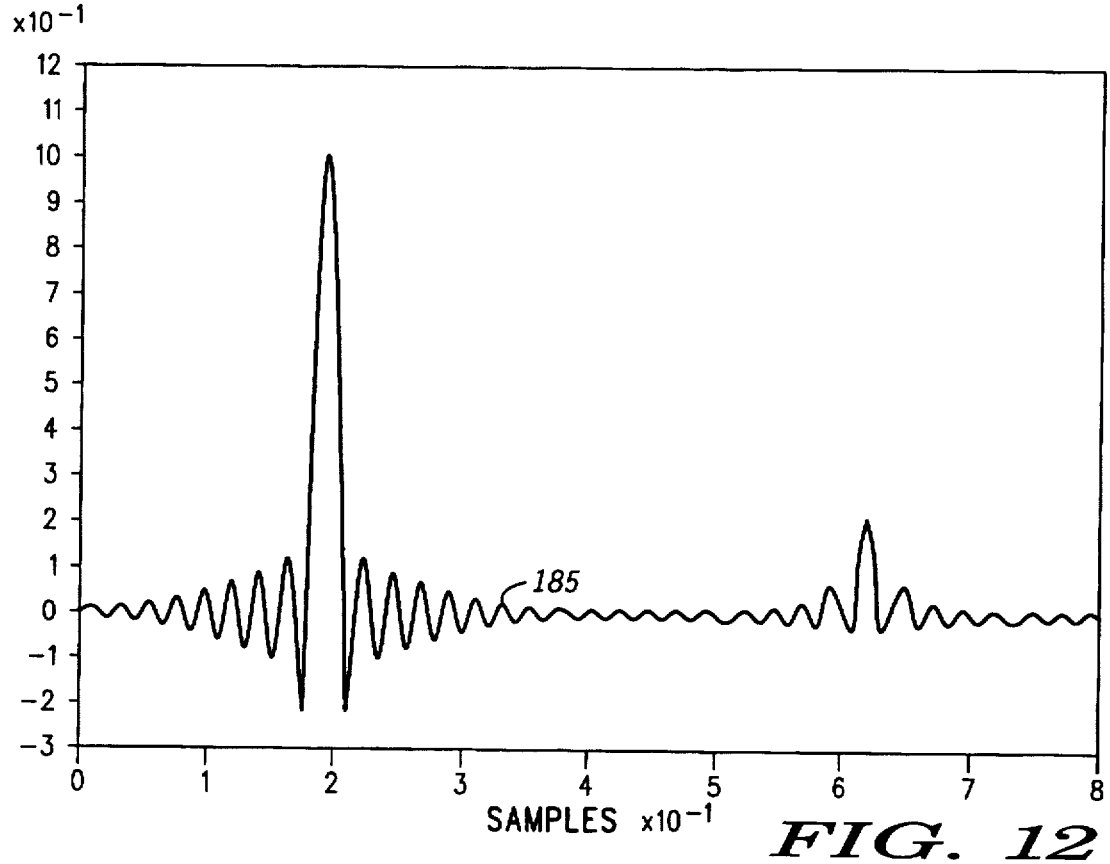
FIG. 12 shows an example of a representative, idealized excitation epoch including an idealized primary and secondary excitation impulse.

Voiced epoch-synchronous excitation waveforms often contain both "primary" and "secondary" excitation components that typically correspond to the high-amplitude major-impulse components and lower-amplitude minor-impulse components, respectively. The excitation containing both components is referred to here as "composite" excitation. As used herein, primary excitation refers to the major residual impulse components, each separated by the pitch period. Secondary excitation refers to lower-amplitude residual excitation which lies between adjacent primary components. FIG. 12 shows an example of a representative, idealized excitation epoch 185 including an idealized primary and secondary excitation impulse.

Figure 13:
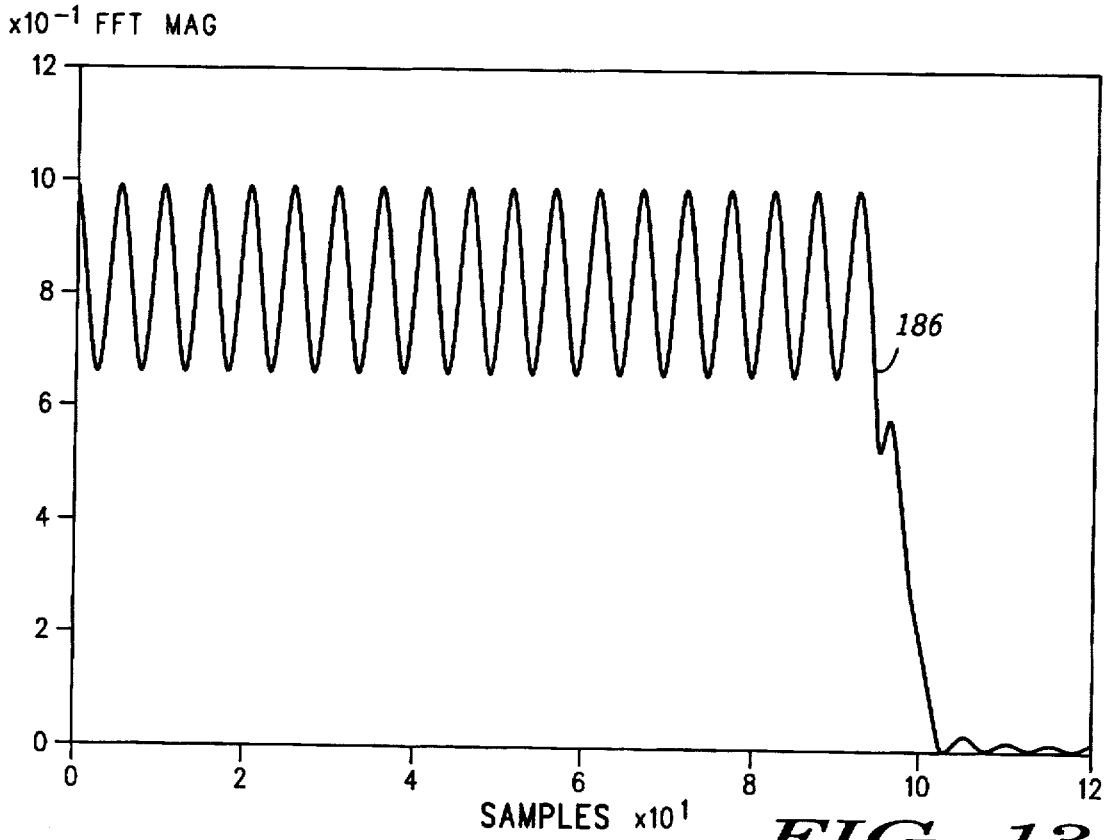
FIG. 13 shows an example of the spectral magnitude representation of an idealized excitation epoch, showing the modulation effects imposed by the secondary excitation impulse in the frequency domain.

It has been determined experimentally that preservation of secondary excitation components is important for accurate, natural-sounding reproduction of speech. Secondary excitation typically imposes pseudo-sinusoidal modulation effects upon the frequency-domain magnitude and phase of the epoch synchronous excitation model. In general, the frequency of the imposed sinusoidal components increases as the secondary-to-primary period (i.e., the distance between the primary and secondary components) increases. FIG. 13 shows an example of the spectral magnitude representation 186 of an idealized excitation epoch, showing the modulation effects imposed by the secondary excitation impulse in the frequency domain.

The secondary time-domain excitation may be characterized separately from the primary excitation by removing the pseudo-sinusoidal components imposed upon the frequency-domain magnitude and phase envelope. Any spectral excitation characterization process that attempts to preserve only the gross envelope of the frequency-domain magnitude and phase waveforms will neglect these important components. Specifically, characterization methods that decimate the spectral components may ignore or even alias the higher frequency pseudo sinusoidal components that result from secondary excitation. By ignoring these components, the reconstructed excitation will not convey the full characteristics of the original, and will hence not fully reproduce the resonance and character of the original speech. In fact, the removal of significant secondary excitation leads to less resonant sounding reconstructed speech. Since characterization methods which rely solely on envelope decimation are unable to fully characterize the nature of secondary excitation components, it is possible to remove these components and characterize them separately.

FIG. 11 illustrates a flowchart of the Characterize Composite Excitation process 56 (FIG. 2) in accordance with a preferred embodiment of the invention. The Characterize Composite Excitation process 56 (FIG. 2) extracts the frequency-domain primary and secondary excitation components. The Characterize Composite Excitation process begins in step 170 by performing the Extract Excitation Segment step 172. The Extract Excitation Segment step 172 selects the excitation portion to be decomposed into its primary and secondary components. In a preferred embodiment, the Extract Excitation Segment step 172 selects pitch synchronous segments or epochs for extraction from the LPC-derived excitation waveform.

Next, the Characterize Primary Component step 174 desirably performs adaptive excitation weighting, cyclic excitation transformation, and dealiasing of spectral phase prior to frequency-domain characterization of the excitation primary components. The adaptive target excitation weighting discussed above has been used with success to preserve the primary excitation components for characterization, while providing the customary FFT window. As would be obvious to one of skill in the art based on the description herein, these steps may be omitted from the Characterize Primary Component step 174 if they are performed as a pre-process. The Characterize Primary Component step 174 preferably characterizes spectral magnitude and phase by energy normalization and decimation in a linear or nonlinear fashion that largely preserves the overall envelope and inherent perceptual characteristics of the frequency-domain components.

Figure 14:
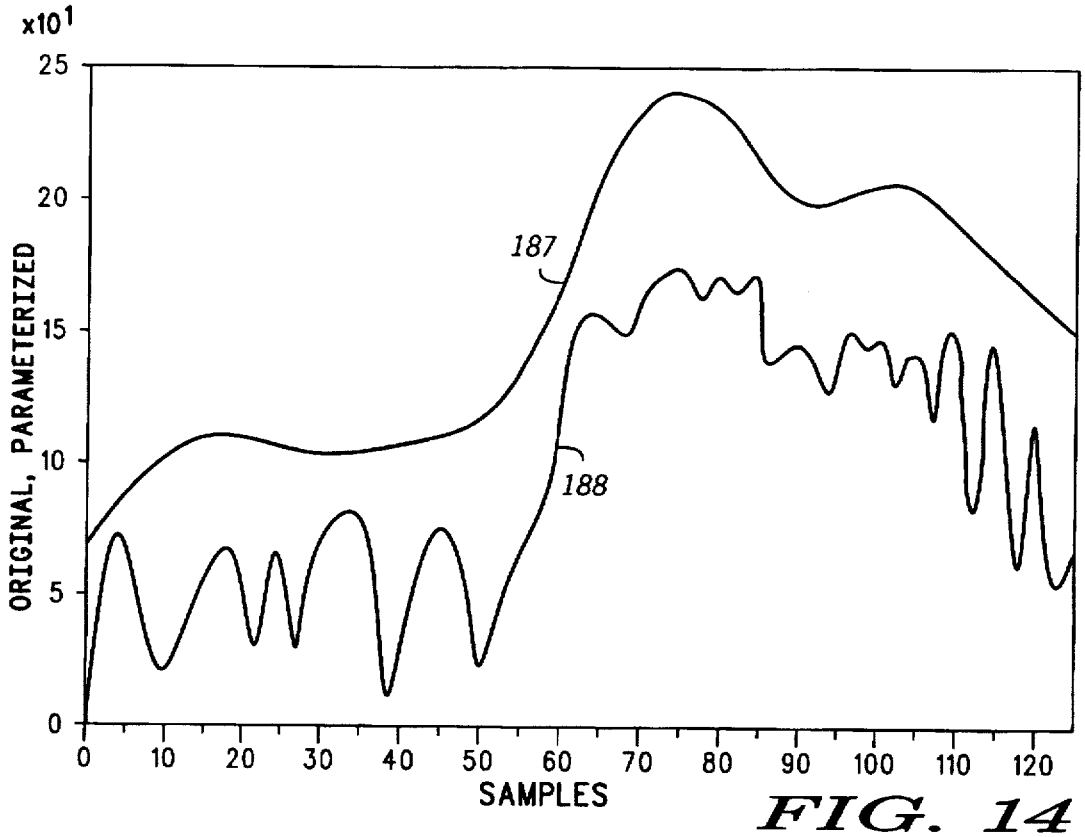
FIG. 14 shows an example of original spectral components of a typical excitation waveform, and the spectral components after an envelope-preserving characterization process in accordance with a preferred embodiment of the present invention.

After the Characterize Primary Component step 174, the Estimate Primary Component step 176 reconstructs an estimate of the original waveform using the characterizing values and their corresponding index locations. This estimate may be computed using linear or nonlinear interpolation techniques. FIG. 14 shows an example of original spectral components 188 of a typical excitation waveform, and the spectral components 187 after a nonlinear envelope-preserving characterization process in accordance with a preferred embodiment of the present invention.

Figure 15:
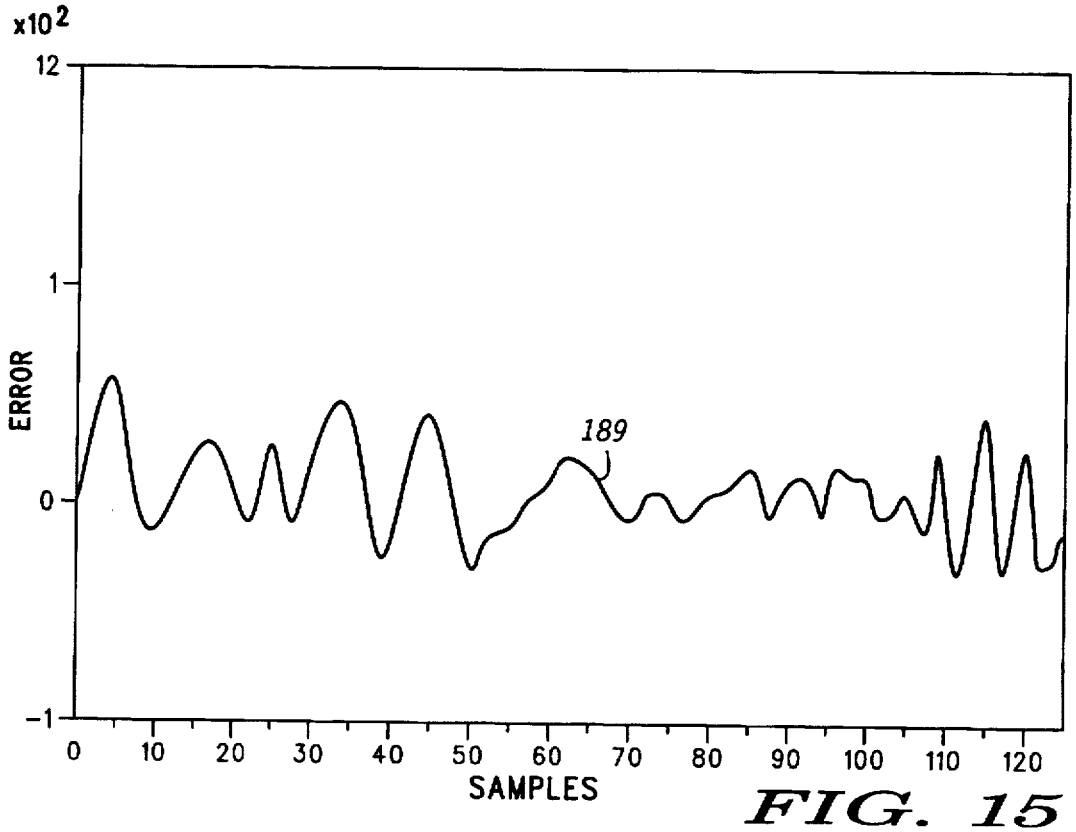
FIG. 15 shows an example of the error of the envelope estimate calculated in accordance with a preferred embodiment of the present invention.

Next, the Compute Error step 178 computes the difference between the estimate from the Estimate Primary Component step 176 and the original waveform. This frequency-domain envelope error largely corresponds to the presence of secondary excitation in the time-domain excitation epoch. In this manner, the original spectral components of the excitation waveform may be subtracted from the waveform that results from the envelope-preserving characterization process. FIG. 15 shows an example of the error 189 of the envelope estimate calculated in accordance with a preferred embodiment of the present invention.

Frequency or time-based characterization methods appropriate to the error waveform may be employed separately, allowing for disjoint transmission of the complete excitation waveform containing both primary and secondary components. A preferred embodiment assumes spectral envelope characterization methods, however, time-domain methods may be substituted as would be obvious to one of skill in the art based on the description. Consequently, the Characterize Error step 180 is performed in an analogous fashion to characterization of the primary components, whereby characterization of the spectral magnitude and phase is performed by energy normalization and decimation in a linear or nonlinear fashion that largely preserves the overall envelope and inherent perceptual characteristics of the frequency-domain components.

Next, the Encode Characterization step 182 encodes the decomposed, characterized primary and secondary excitation components for transmission. For example, the characterized primary and secondary excitation components may be encoded using codebook methods, such as VQ, split vector quantization, or multi-stage vector quantization, these methods being well known to those of skill in the art. In an alternate embodiment, the Encode Characterization step 182 can be included in the Analysis Post-Processing step 60 (FIG. 2).

The Characterize Composite Excitation process then exits in step 184. The Characterize Composite Excitation process is presented in the context of frequency-domain decomposition of primary and secondary excitation epoch components. However, the concepts addressing primary and secondary decomposition may also be applied to the time-domain excitation waveform, as is understood by those of skill in the art based on the description. For example, in a time-domain characterization method, the weighted time-domain excitation portion (e.g., from the Weight Excitation step 48, FIG. 2) may be subtracted from the original excitation segment to obtain the secondary portion not represented by the primary time-domain characterization method.

4. Excitation Pulse Compression Filter

Low-rate speech coding methods that implement frequency-domain, epoch-synchronous excitation characterization often employ a significant number of bits for characterization of the group delay envelope. Since the epoch-synchronous group delay envelope conveys less perceptual information than the magnitude envelope, such methods can benefit from characterizing the group delay envelope at low resolution, or not at all for very low rate applications.

In this manner, the method and apparatus of the present invention reduces the required bit rate, while maintaining natural-sounding synthesized speech. As such, reasonably high-quality speech is synthesized directly from excitation epochs exhibiting zero epoch-synchronous spectral group delay. Specific signal conditioning procedures are applied in either the time or frequency domain to achieve zero epoch-synchronous spectral group delay. Frequency-domain methods desirably null the group delay waveform by means of forward and inverse Fourier transforms. The method of the preferred embodiment uses efficient, time-domain excitation group delay removal procedures at the analysis device, resulting in zero group delay excitation epochs. Such epochs possess symmetric qualities that can be efficiently encoded in the time domain, eliminating the need for computationally intensive frequency-domain transformations.

In order to enhance speech quality, an artificial or preselected excitation group delay characteristic can optionally be introduced at the synthesis device after reconstruction of the characterized excitation segment.

In this manner, smooth, natural-sounding speech may be synthesized from reconstructed, interpolated, target epochs that have been processed in the Excitation Pulse Compression Filter step 50. The Excitation Pulse Compression Filter process 50 (FIG. 2) removes the excitation group delay on an epoch-synchronous basis using time-domain filtering. Hence, the Excitation Pulse Compression Filter process 50 (FIG. 2) is a time-domain method that provides for natural-sounding speech quality, computational simplification, and bit-rate reduction relative to prior-art methods.

The Excitation Pulse Compression Filter process 50 (FIG. 2) can be applied on a frame or epoch-synchronous basis. The Excitation Pulse Compression Filter process 50 (FIG. 2) is desirably applied using a matched filter on a epoch-synchronous basis to a predetermined "target" epoch chosen in the Select Target step 46 (FIG. 2). Methods other than match-filtering may be used as would be obvious to one of skill in the art based on the description. The symmetric, time-domain properties (and corresponding zero group delay frequency domain properties) allow for simplified characterization of the resulting impulse-like target.

Figure 16:
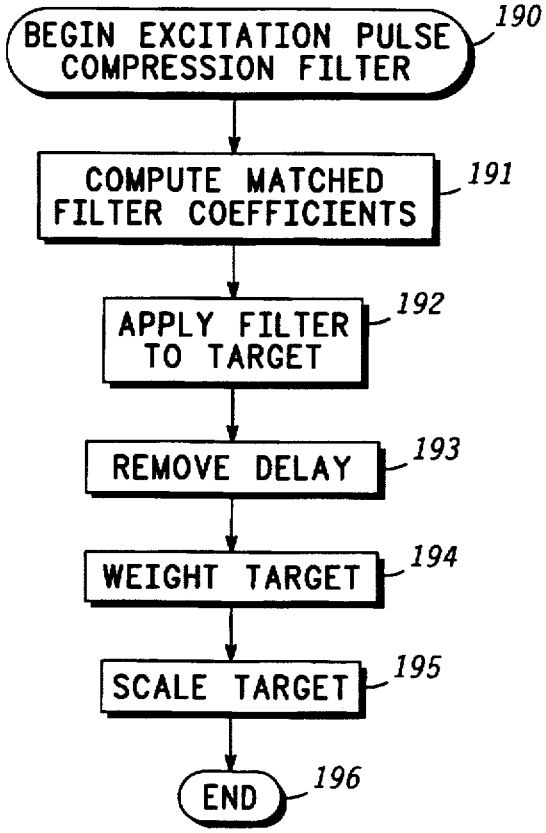
FIG. 16 illustrates a flow chart of a method for applying an excitation pulse compression filter to a target excitation epoch in accordance with an alternate embodiment of the present invention.

FIG. 16 illustrates the Excitation Pulse Compression Filter process 50 (FIG. 2) which applies an excitation pulse compression filter to an excitation target in accordance with an alternate embodiment of the present invention. The Excitation Pulse Compression Filter process 50 (FIG. 2) begins in step 190 with the Compute Matched Filter Coefficients step 191. The Compute Matched Filter Coefficients step 191 determines matched filter coefficients that serve to cancel the group delay characteristics of the excitation template and excitation epochs in proximity to the excitation template. For example, an optimal ("opt") matched filter, familiar to those skilled in the art, may be defined by:

$$H_{opt}(w)=KX^*(w)e^{-jwT}, \quad \text{(Eqn. 1)}$$

where $H_{opt}(w)$ is the frequency-domain transfer function of the matched filter, $X^*(w)$ is the conjugate of an input signal spectrum (e.g., a spectrum of the excitation template) and K is a constant. Given the conjugation property of Fourier transforms:

$$x^*(-t)<->X^*(w), \quad \text{(Eqn. 2)}$$

the impulse response of the optimum filter is given by:

$$h_{opt}(t)=Kx^*(T-t), \quad \text{(Eqn. 3)}$$

where $h_{opt}(t)$ defines the time-domain matched compression filter coefficients, T is the "symbol interval", and $x^*(T-t)$ is the conjugate of a shifted mirror-image of the "symbol" x(t). The above relationships are applied to the excitation compression problem by considering the selected excitation template to be the symbol x(t). The symbol interval, T, is desirably the excitation template length. The time-domain matched compression filter coefficients, defined by $h_{opt}(t)$, are conveniently determined from Eqn. 3, thus eliminating the need for a frequency domain transformation (e.g., Fast Fourier Transform) of the excitation template (as used with other methods). Constant K is desirably chosen to preserve overall energy characteristics of the filtered waveform relative to the original, and is desirably computed directly from the time domain template.

The Compute Matched Filter Coefficients step 191 provides a simple, time-domain excitation pulse compression filter design method that eliminates computationally expensive Fourier Transform operations associated with other techniques.

Figure 17:
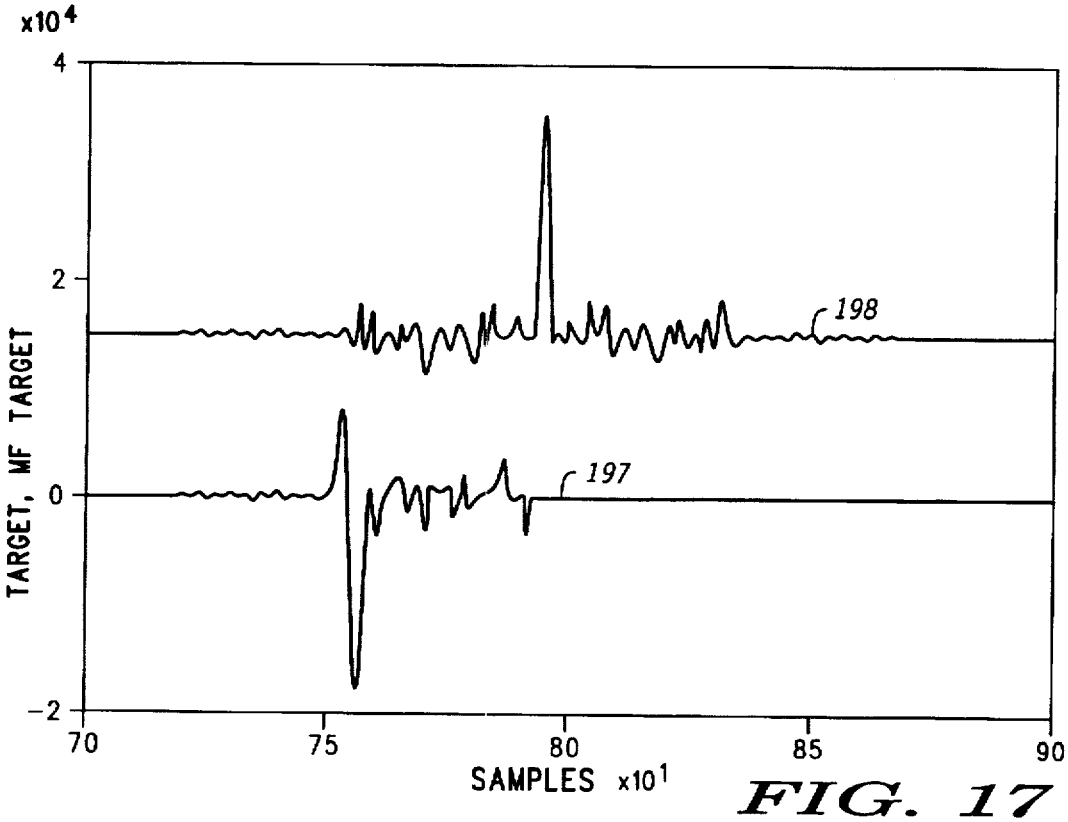
FIG. 17 shows an example of an original target and a target that has been excitation pulse compression filtered in accordance with an alternate embodiment of the present invention.

The Apply Filter to Target step 192 is then performed. This step uses the filter impulse response derived from Eqn. 3 as the taps for a finite impulse response (FIR) filter, which is used to filter the excitation target. FIG. 17 shows an example of an original target 197, and an excitation pulse compression filtered target 198 that has been filtered in accordance with an alternate embodiment of the present invention.

Next, the Remove Delay step 193 then shifts the filtered target to remove the filter delay. In this embodiment, the shift is equal to 0.5 the interval length of the excitation segment being filtered although other shift values may also be appropriate.

Figure 18:
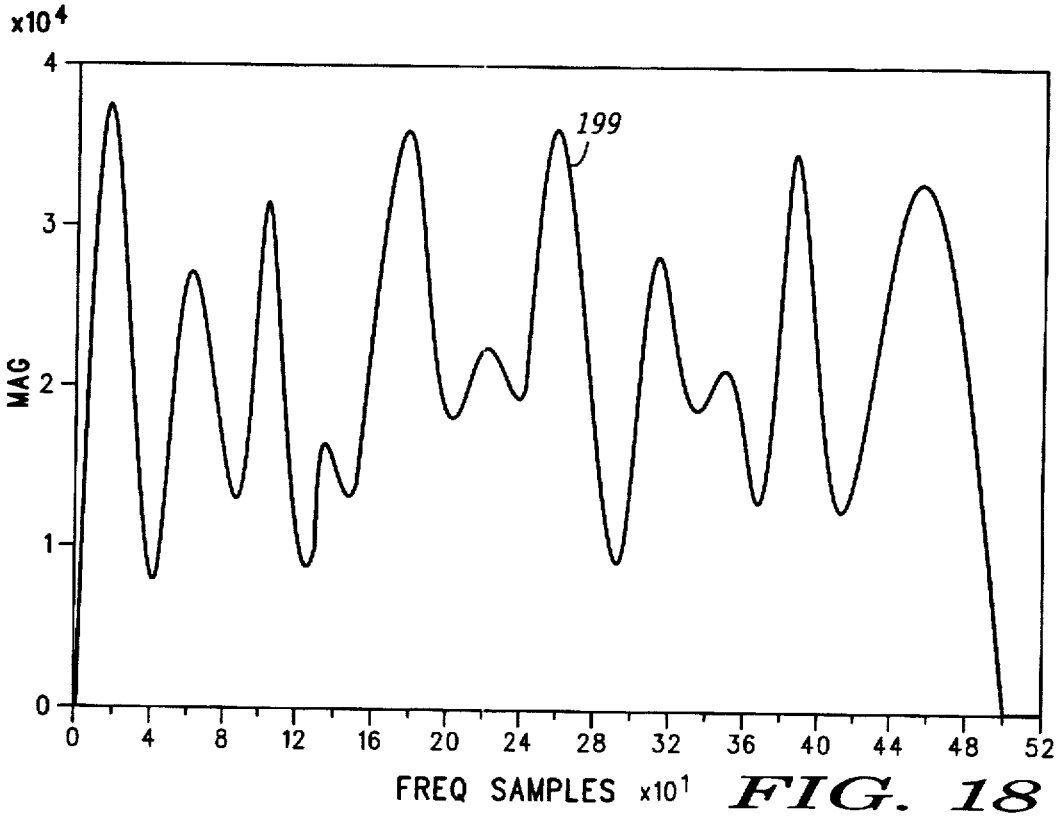
FIG. 18 shows an example of a magnitude spectrum after application of a rectangular, sinusoidal roll-off window to the pulse compression filtered excitation in accordance with an alternate embodiment of the present invention.

The Weight Target step 194 is then performed to weight the filtered, shifted target with a window function (e.g., rectangular window with sinusoidal roll-off or lamming window) of an appropriate length. Desirably, a rectangular sinusoidal roll-off window (for example, with 20% roll off) is applied. Properly configured, such a window can impose less overall envelope distortion than a Hamming window. FIG. 18 shows an example of a magnitude spectrum 199 after application of a rectangular, sinusoidal roll-off window to the pulse compression filtered excitation in accordance with an alternate embodiment of the present invention. Application of a window function serves two purposes. First, application of the window attenuates the expanded match - filtered epoch to the appropriate pitch length.

Second, the window application smoothes the sharpened spectral magnitude of the match-filtered target to better represent the original epoch spectral envelope. As such, the excitation magnitude spectrum 199 that results from the windowing process is appropriate for synthesis of speech using direct-form or lattice synthesis filtering.

The Scale Target step 195 provides optional block energy scaling of the match-filtered, shifted, weighted target. As is obvious based upon the description, the block scaling step 195 may be implemented in lieu of scaling factor K of Eqn. 3.

The Excitation Pulse Compression Filter process 50 (FIG. 2) can be applied on a frame or epoch-synchronous basis. In an alternate embodiment, the Excitation Pulse Compression Filter process 50 (FIG. 2) is applied on a epoch-synchronous basis to a predetermined "target" epoch chosen in the Select Target step 46 (FIG. 2). The symmetric time-domain properties (and corresponding zero group delay frequency domain properties) allow for simplified characterization of the resulting impulse-like target.

The Excitation Pulse Compression Filter process exits in step 196.

Figure 19:
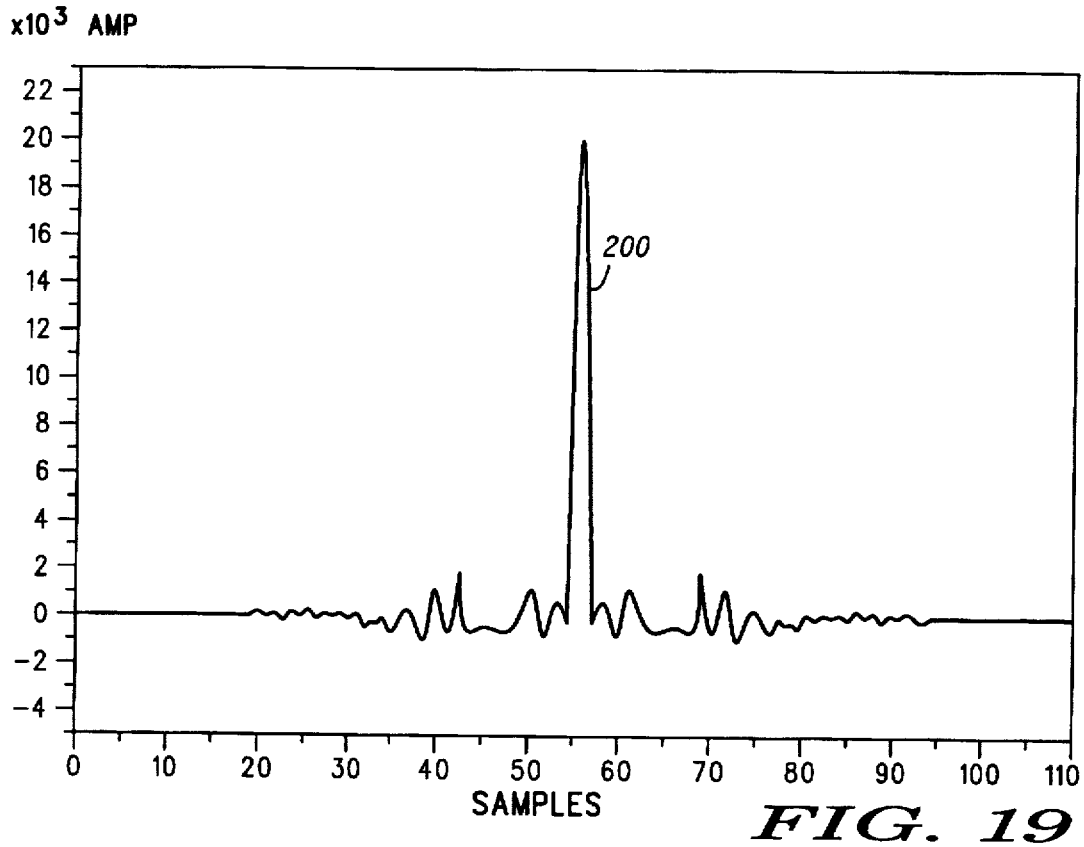
FIG. 19 shows an example of a target waveform that has been excitation pulse compression filtered, shifted, and weighted in accordance with an alternate embodiment of the present invention.

FIG. 19 shows an example of a target waveform 200 after the Apply Filter to Target step 192, the Remove Delay step 193, and the Weight Target step 194 performed in accordance with an alternate embodiment of the present invention.

5. Characterize Symmetric Excitation

The Characterize Symmetric Excitation process 58 (FIG. 2) is a time-domain characterization method which exploits the attributes of a match filtered target excitation segment. Time-domain characterization offers a computationally straightforward way of representing the match filtered target that avoids Fourier transform operations. Since the match filtered target is an even function (i.e., perfectly symmetrical about the peak axis), only half of the target need be characterized and quantized. In this manner, the Characterize Symmetric Excitation process 58 (FIG. 2) splits the target in half about the peak axis, amplitude normalizes, and length normalizes the split target. In an alternate embodiment, energy normalization may be employed rather than amplitude normalization.

Figure 20:
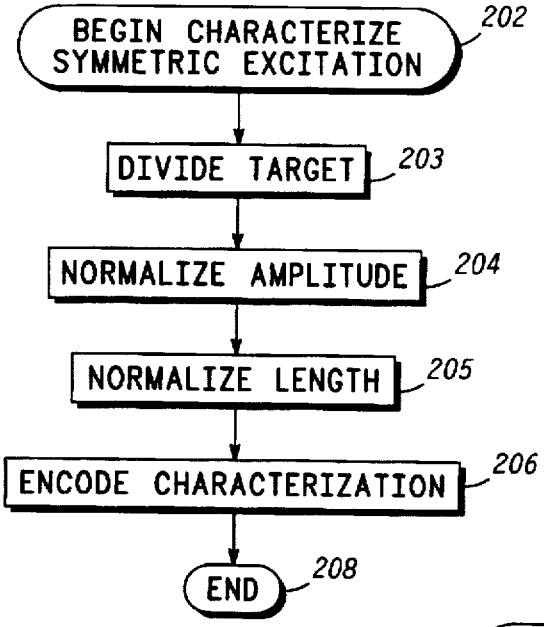
FIG. 20 illustrates a flow chart of a method for characterizing the symmetric excitation waveform in accordance with an alternate embodiment of the present invention.

FIG. 20 illustrates a flowchart of the Characterize Symmetric Excitation process 58 (FIG. 2) in accordance with an alternate embodiment of the present invention. The Characterize Symmetric Excitation Waveform process begins in step 202 by performing the Divide Target step 203. In a preferred embodiment, the Divide Target step 203 splits the symmetric match-filtered excitation target at the peak axis, resulting in a half symmetric target. In an alternate embodiment, less than a full half target may be used, effectively reducing the number of bits required for quantization.

Figure 21:
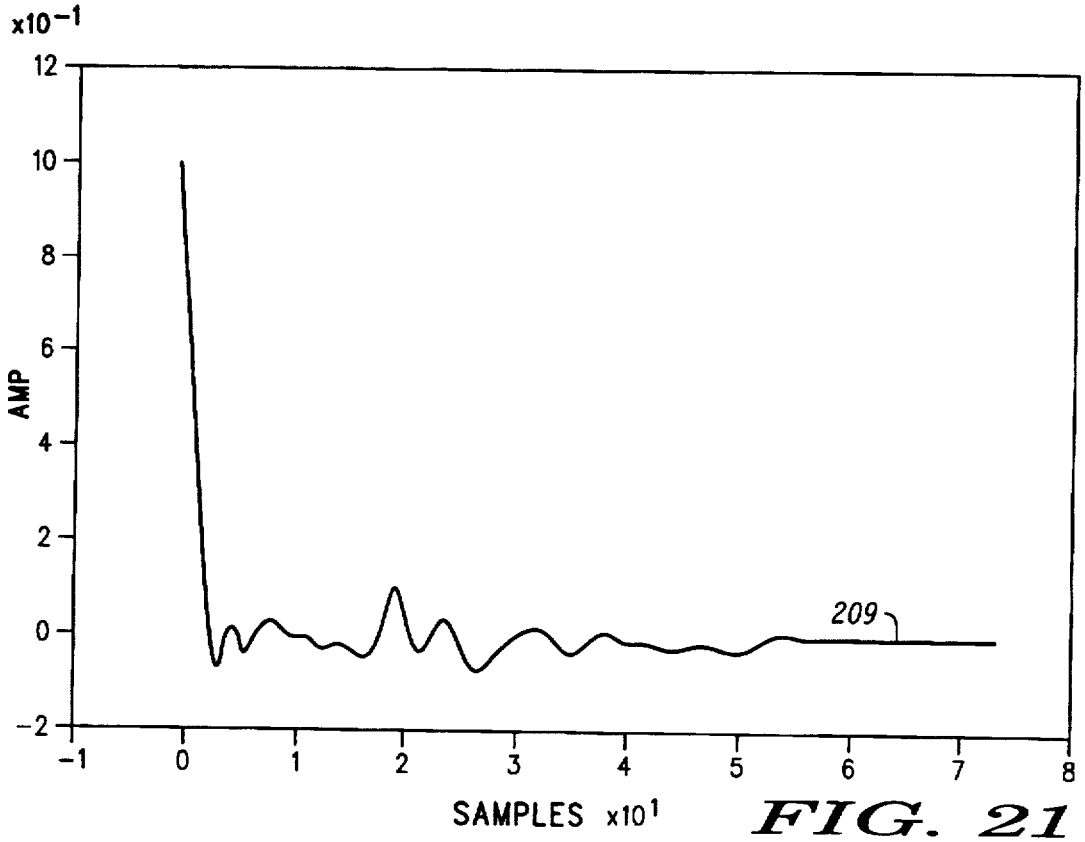
FIG. 21 illustrates a symmetric, filtered target that has been divided, amplitude normalized, and length normalized in accordance with an alternate embodiment of the present invention.

Following the Divide Target step 203, the Normalize Amplitude step 204 desirably normalizes the divided target to a unit amplitude. In an alternate embodiment, the match-filtered target may be energy normalized rather than amplitude normalized as would be obvious to one of skill in the art based on the description herein. The Normalize Length step 205 then length normalizes the target to a normalizing length of an arbitrary number of samples. For example, the sample normalization length may be equal to or greater than 0.5 times the expected pitch range in samples. Amplitude and length normalization reduces quantization vector variance, effectively reducing the required codebook size. A linear or nonlinear interpolation method is used for interpolation. In a preferred embodiment, cubic spline interpolation is used to length normalize the target. As described in conjunction with FIG. 27, inverse processes will be performed to reconstruct the target at the synthesis device. FIG. 21 illustrates a symmetric, filtered target 209 that has been divided, amplitude normalized, and length normalized to a 75 sample length in accordance with an alternate embodiment of the present invention.

Next, the Encode Characterization step 206 encodes the match-filtered, divided, normalized excitation segment for transmission. For example, the excitation segment may be encoded using codebook methods such as VQ, split vector quantization, or multi-stage vector quantization, these methods being well known to those of skill in the art. In an alternate embodiment, the Encode Characterization step 206 can be included in Analysis Post-Processing step 60 (FIG. 2).

The Characterize Symmetric Excitation process exits in step 208.

B. Speech Synthesis

After speech excitation has been analyzed, encoded, and transmitted to the synthesis device 24 (FIG. 1) or retrieved from a memory device, the encoded speech parameters and excitation components must be decoded, reconstructed and used to synthesize an estimate of the original speech waveform. In addition to excitation waveform reconstruction considered in this invention, decoded parameters used in typical LPC-based speech coding include pitch, voicing, LPC spectral information, synchronization, waveform energy, and optional target location.

Figure 22:
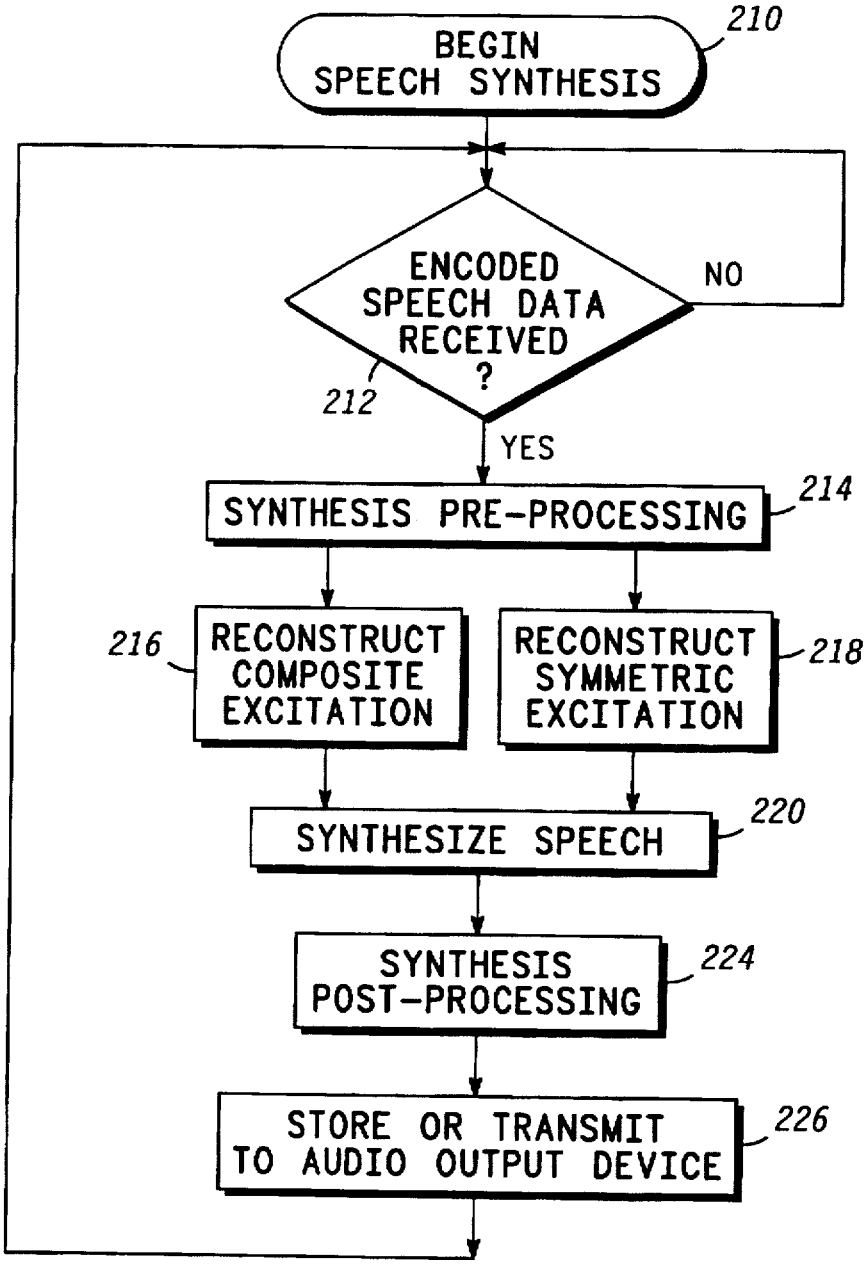
FIG. 22 illustrates a flow chart of a method for synthesizing voiced speech in accordance with a preferred embodiment of the present invention.

FIG. 22 illustrates a flow chart of a method for synthesizing voiced speech in accordance with a preferred embodiment of the present invention. Unvoiced speech can be synthesized, for example, by companion methods which reconstruct the unvoiced excitation segments at the synthesis device by way of amplitude modulation of pseudo-random data. Amplitude modulation characteristics can be defined by unvoiced characterization procedures at the analysis device that measure, encode, and transmit only the envelope of the unvoiced excitation data.

The speech synthesis process is carried out by synthesis processor 28 (FIG. 1). The Speech Synthesis process begins in step 210 with the Encoded Speech Data Received step 212, which determines when encoded speech data is received. In an alternate embodiment, encoded speech data is retrieved from a memory device, thus eliminating the Encoded Speech Data Received step 212.

When no encoded speech data is received, the procedure iterates as shown in FIG. 22. When encoded speech data is received, the Synthesis Pre-Processing step 214 decodes the encoded speech parameters and excitation data using scalar, vector, split vector, or multi-stage vector quantization codebooks, companion to those used in the Analysis Post-Processing step 60 (FIG. 2).

In a preferred embodiment, decoding of the characterization data is followed by the Reconstruct Composite Excitation process 216 which is performed as a companion process to the Cyclic Excitation Transform process 52 (FIG. 2), the Dealias Excitation Phase process 54 (FIG. 2) and the Characterize Composite Excitation process 56 (FIG. 2) that were performed by the analysis processor 18 (FIG. 1). The Reconstruct Composite Excitation process 216 constructs and recombines the primary and secondary excitation segment component estimates and reconstructs an estimate of the complete excitation waveform. The Reconstruct Composite Excitation process 216 is described in more detail in conjunction with FIG. 26.

In an alternate embodiment, the Reconstruct Symmetric Excitation process 218 is performed as a companion process to the Excitation Pulse Compression Filter process 50 (FIG. 2) and the Characterize Symmetric Excitation process 58 (FIG. 2) that were performed by the analysis processor 18 (FIG. 1). The Reconstruct Symmetric Excitation process 218 reconstructs the symmetric excitation segments and excitation waveform estimate and is described in more detail in conjunction with FIG. 27.

Following reconstruction of the excitation waveform from either step 216 or step 218, the reconstructed excitation waveform and corresponding LPC coefficients are used to synthesize natural sounding speech. As would obvious to one of skill in the art based on the description, epoch-synchronous LPC information (e.g., reflection coefficients or line spectral frequencies) that correspond to the epoch-synchronous excitation are replicated or interpolated in a low-rate coding structure. The Synthesize Speech step 220 desirably implements a frame or epoch-synchronous synthesis method which can use direct-form synthesis or lattice synthesis of speech. In a preferred embodiment, epoch-synchronous synthesis is implemented in the Synthesize Speech step 220 using a direct-form, all-pole infinite impulse response (IIR) filter excited by the excitation waveform estimate.

The Synthesis Post-Processing step 224 is then performed, which includes fixed and adaptive post-filtering methods well known to those skilled in the art. The result of the Synthesis Post-Processing step 224 is synthesized speech data.

The synthesized speech data is then desirably stored 226 or transmitted to an audio-output device (e.g., digital-to-analog converter 32 and speaker 34, FIG. 1).

The Speech Synthesis process then returns to the Encoded Speech Data Received step 212, and the procedure iterates as shown in FIG. 22.

1. Nonlinear Spectral Reconstruction

Reduced-bandwidth voice coding applications that implement pitch-synchronous spectral excitation modeling must also accurately reconstruct the excitation waveform from its characterized spectral envelopes in order to guarantee optimal speech reproduction. Discontinuous linear piecewise reconstruction techniques employed in other methods can occasionally introduce noticeable distortion upon reconstruction of certain target excitation epochs. For these occasional, distorted targets, frame to frame epoch interpolation produces a poor estimate of the original excitation, leading to artifacts in the reconstructed speech.

The Nonlinear Spectral Reconstruction process represents an improvement over prior-art linear-piecewise techniques. The Nonlinear Spectral Reconstruction process interpolates the characterizing values of spectral magnitude and phase in a non-linear fashion to recreate a more natural, continuous estimate of the original frequency-domain envelopes.

Figure 23:
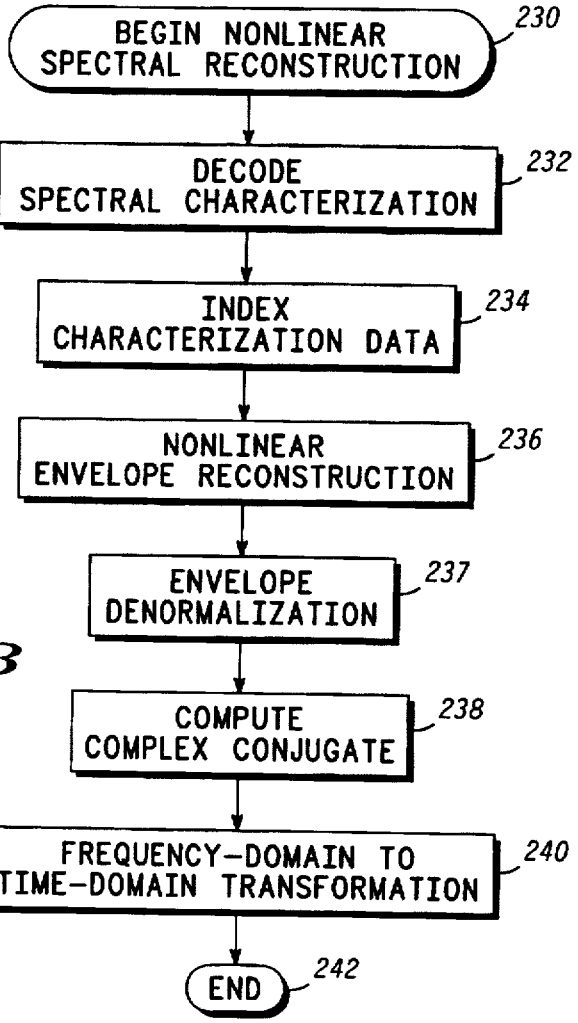
FIG. 23 illustrates a flow chart of a method for nonlinear spectral envelope reconstruction in accordance with a preferred embodiment of the present invention.

FIG. 23 illustrates a flowchart of the Nonlinear Spectral Reconstruction process in accordance with a preferred embodiment of the present invention. The Nonlinear Spectral Reconstruction process is a general technique of decoding decimated spectral characterization data and reconstructing an estimate of the original waveforms.

The Nonlinear Spectral Reconstruction process begins in step 230 by performing the Decode Spectral Characterization step 232. The Decode Spectral Characterization step 232 reproduces the original characterizing values from the encoded data using vector quantizer codebooks corresponding to the codebooks used by the analysis device 10 (FIG. 1).

Next, the Index Characterization Data step 234 uses apriori modeling information to reconstruct the original envelope array, which must contain the decoded characterizing values in the proper index positions. For example, transmitter characterization could utilize preselected index values with linear spacing across frequency, or with non-linear spacing that more accurately represents baseband information. At the receiver, the characterizing values are placed in their proper index positions according to these preselected index values.

Figure 24:
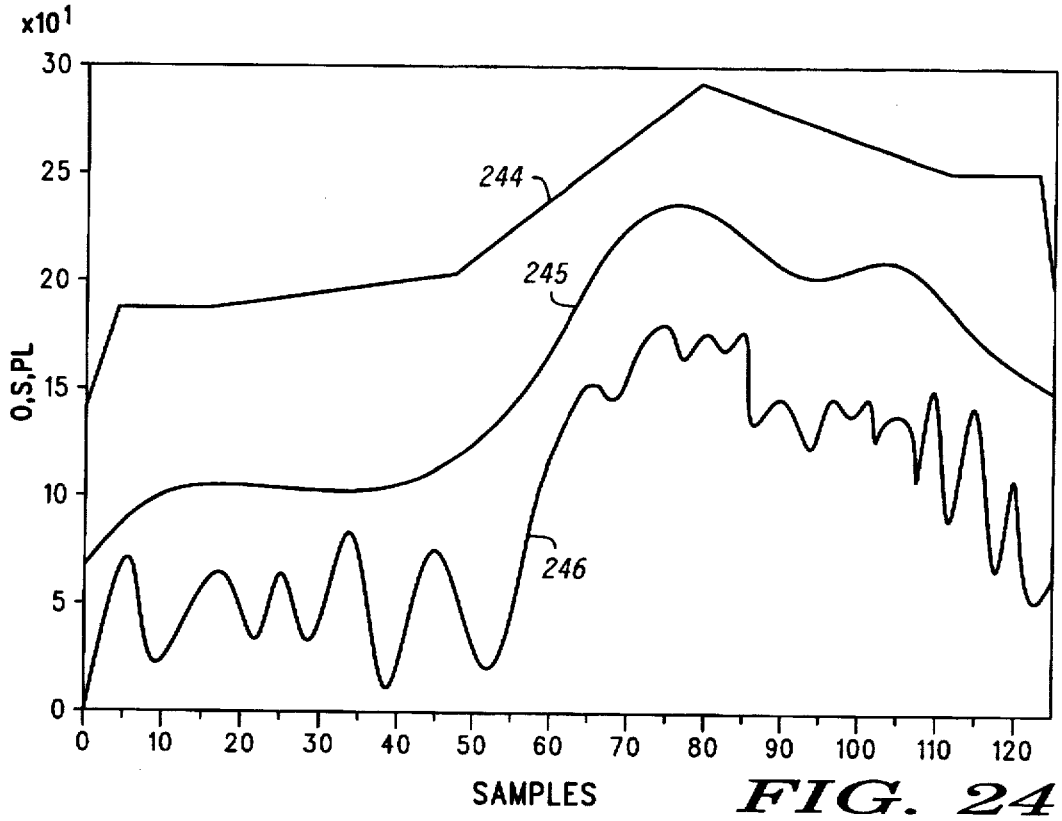
FIG. 24 shows an example of original spectral data, cubic spline reconstructed spectral data generated in accordance with a preferred embodiment of the present invention, and piecewise linear reconstructed spectral data generated in accordance with prior-art methods.

Next, the Reconstruct Nonlinear Envelope step 236 uses an appropriate nonlinear interpolation technique (e.g., cubic spline interpolation, which is well known to those in the relevant art) to smoothly reproduce the elided envelope values. Such nonlinear techniques for reproducing the spectral envelope result in a continuous, natural envelope estimate. FIG. 24 shows an example of original spectral data 246, cubic spline reconstructed spectral data 245 generated in accordance with a preferred embodiment of the present invention, and piecewise linear reconstructed spectral data 244 generated in accordance with a prior-art method.

Following the Nonlinear Envelope Reconstruction step 236, the Envelope Denormalization step 237 is desirably performed, whereby any normalization process implemented at the analysis device 10 (FIG. I) (e.g., energy or amplitude normalization) is reversed at the synthesis device 24 (FIG. 1) by application of an appropriate scaling factor over the waveform segment under consideration.

Next, the Compute Complex Conjugate step 238 positions the reconstructed spectral magnitude and phase envelope and its complex conjugate in appropriate length arrays. The Compute Complex Conjugate step 238 ensures a real-valued time-domain result.

Figure 25:
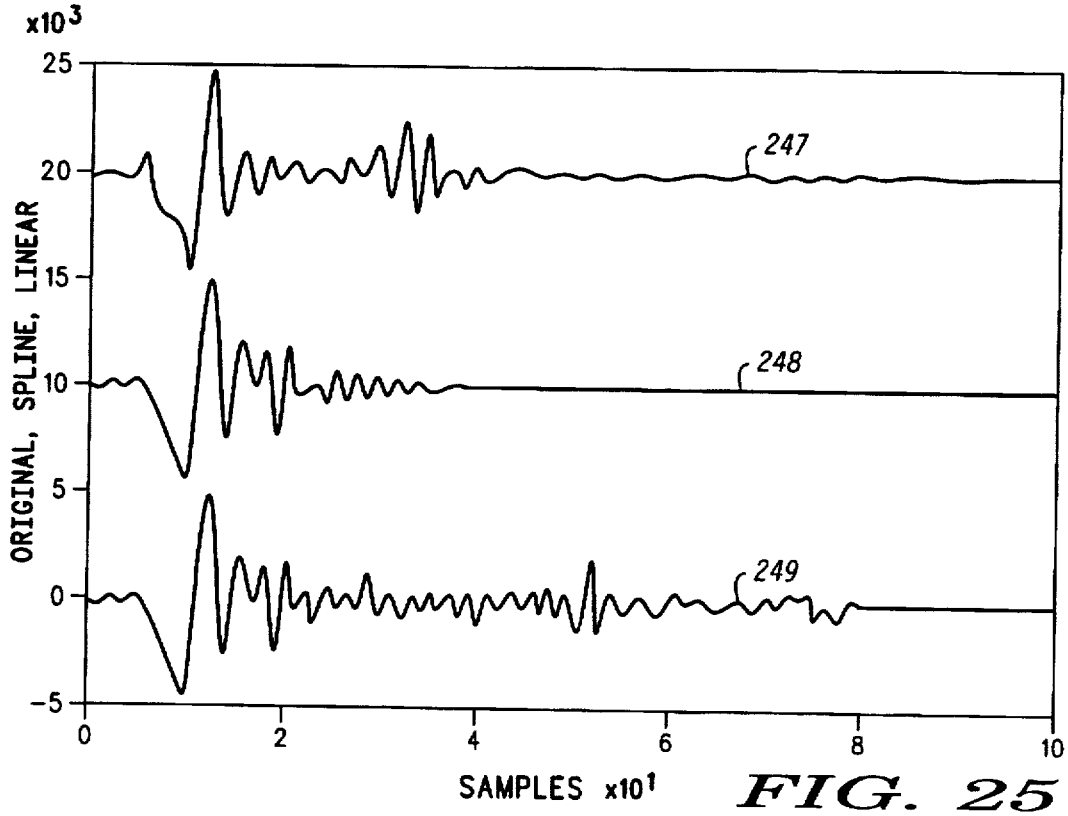
FIG. 25 shows an example of original excitation data, cubic spline reconstructed data generated in accordance with a preferred embodiment of the present invention, and piecewise linear reconstructed data generated in accordance with prior-art methods.

After the Compute Complex Conjugate step 238, the Frequency-Domain to Time-Domain Transformation step 240 creates the time-domain excitation epoch estimate. For example, an inverse FFT may be used for this transformation. This inverse Fourier transformation of the smoothly reconstructed spectral envelope estimate is used to reproduce the real-valued time-domain excitation waveform segment, which is desirably epoch-synchronous in nature. FIG. 25 shows an example of original excitation data 249, cubic spline reconstructed data 248 generated in accordance with a preferred embodiment of the present invention, and piecewise linear reconstructed data 247 generated in accordance with a prior-art method.

The Nonlinear Spectral Reconstruction process then exits in step 242. Using this improved epoch reconstruction method, a more accurate, improved estimate of the original excitation epoch is often obtained over linear piecewise methods. Improved epoch reconstruction enhances the excitation waveform estimate derived by subsequent ensemble interpolation techniques.

2. Reconstruct Composite Excitation

Given the characterized composite excitation segment produced by the Characterize Composite Excitation process (FIG. 11), a companion process, the Reconstruct Composite Excitation process 216 (FIG. 22) reconstructs the composite excitation segment and excitation waveform in accordance with a preferred embodiment of the invention.

Figure 26:
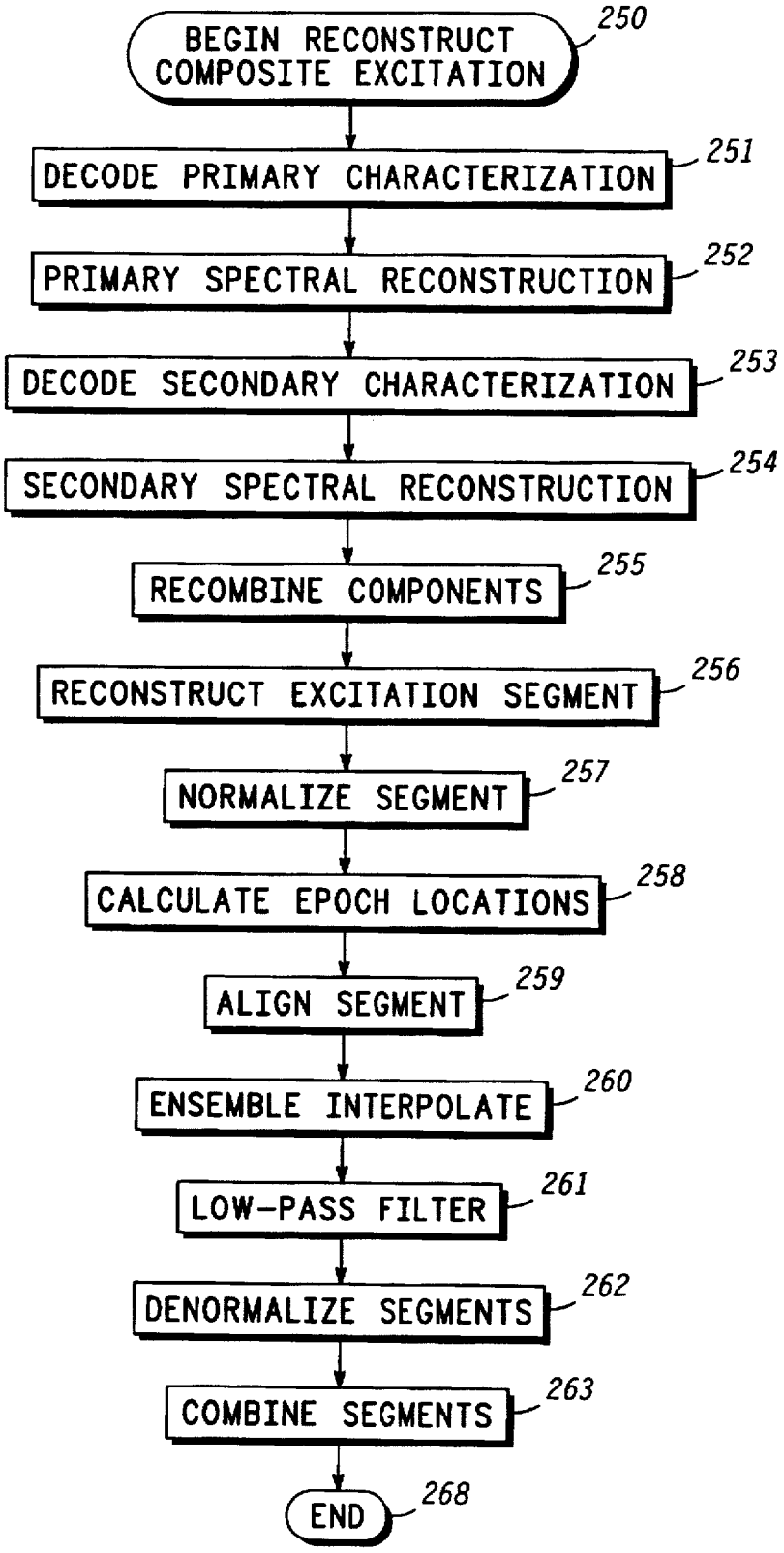
FIG. 26 illustrates a flow chart of a method for reconstructing the composite excitation in accordance with a preferred embodiment of the present invention.

FIG. 26 illustrates a flowchart of the Reconstruct Composite Excitation process 216 (FIG. 22) in accordance with a preferred embodiment of the present invention. The Reconstruct Composite Excitation process begins in step 250 by performing the Decode Primary Characterization step 251. The Decode Primary Characterization step 251 reconstructs the primary characterizing values of excitation from the encoded representation using the companion vector quantizer codebook to the Encode Characterization step 182 (FIG. 11). As would be obvious to one of skill in the art based on the description, the Decode Primary Characterization step 251 may be omitted if this step has been performed by the Synthesis Pre-Processing step 214 (FIG. 22).

Next, the Primary Spectral Reconstruction step 252 indexes characterizing values, reconstructs a nonlinear envelope, denormalizes the envelope, creates spectral complex conjugate, and performs frequency-domain to time-domain transformation. These techniques are described in more detail in conjunction with the general Nonlinear Spectral Reconstruction process (FIG. 23).

The Decode Secondary Characterization step 253 reconstructs the secondary characterizing values of excitation from the encoded representation using the companion vector quantizer codebook to the Encode Characterization step 182 (FIG. 11). As would be obvious to one of skill in the art based on the description, the Decode Secondary Characterization step 253 may be omitted if this step has been performed by the Synthesis Pre-Processing step 214 (FIG. 22).

Next, the Secondary Spectral Reconstruction step 254 indexes characterizing values, reconstructs a nonlinear envelope, denormalizes the envelope, creates spectral complex conjugate, and performs frequency-domain to time-domain transformation. These techniques are described in more detail in conjunction with the general Nonlinear Spectral Reconstruction process (FIG. 23).

Although the Decode Secondary Characterization step 253 and the Secondary Spectral Reconstruction step 254 are shown in FIG. 26 to occur after the Decode Primary Characterization step 251 and the Primary Spectral Reconstruction step 252, they may also occur before or during these latter processes, as would be obvious to those of skill in the art based on the description.

Next, the Recombine Component step 255 adds the separate estimates to form a composite excitation waveform segment. In a preferred embodiment, the Recombine Component step 255 recombines the primary and the secondary components in the time-domain. In an alternate embodiment, the Primary Spectral Reconstruction step 252 and the Secondary Spectral Reconstruction 254 steps do not perform frequency-domain to time domain transformations, leaving the Recombine Component step 255 to combine the primary and secondary components in the frequency domain. In this alternate embodiment, the Reconstruct Excitation Segment step 256 performs a frequency-domain to time-domain transformation in order to recreate the excitation epoch estimate.

Following reconstruction of the excitation segment, the Normalize Segment step 257 is desirably performed. This step implements linear or non-linear interpolation to length normalize the excitation segment in the current frame to an arbitrary number of samples, M, which is desirably larger than the largest expected pitch period in samples. The Normalize Segment step 257 serves to improve the subsequent alignment and ensemble interpolation, resulting in a smoothly evolving excitation waveform. In a preferred embodiment of the invention, nonlinear cubic spline interpolation is used to normalize the segment to an arbitrary length of, for example, M=200 samples.

Next, the Calculate Epoch Locations step 258 is performed, which calculates the intervening number of epochs, N, and corresponding epoch positions based upon prior frame target location, current frame target location, prior frame target pitch, and current frame target pitch. Current frame target location corresponds to the target location estimate derived in a preferred closed-loop embodiment employed at the analysis device 10 (FIG. 1). Locations are computed so as to ensure a smooth pitch evolution from the prior target, or source, to the current target, as would be obvious to one of skill in the art based on the description. The result of the Calculate Epoch Locations step 258 is an array of epoch locations spanning the current excitation segment being reconstructed.

The Align Segment step 259 is then desirably performed, which correlates the length-normalized target against a previous length-normalized source. In a preferred embodiment, a linear correlation coefficient is computed over a range of delays corresponding to a fraction of the segment length, for example 10% of the segment length. The peak linear correlation coefficient corresponds to the optimum alignment offset for interpolation purposes. The result of Align Segment step 259 is an optimal alignment offset, O, relative to the normalized target segment.

Following target alignment, the Ensemble Interpolate step 260 is performed, which uses the length-normalized source and target segments and the alignment offset, O, to derive the intervening excitation that was discarded at the analysis device 10 (FIG. 1). The Ensemble Interpolate step 260 generates each of N intervening epochs, where N is derived in the Calculate Epoch Locations step 258.

Next, the Low-Pass Filter step 261 is desirably performed on the ensemble-interpolated, M sample excitation segments in order to condition the upsampled, interpolated data for subsequent downsampling operations. A low-pass filter cutoff, $f_c$, is desirably selected in an adaptive fashion to accommodate the time-varying downsampling rate defined by the current target pitch value and intermediate pitch values calculated in the Calculate Epoch Locations step 258.

Following the Low-Pass Filter step 261, the Denormalize Segments step 262 downsamples the upsampled, interpolated, low-pass filtered excitation segments to segment lengths corresponding to the epoch locations derived in the Calculate Epoch Locations step 258. In a preferred embodiment, a nonlinear cubic spline interpolation is used to derive the excitation values from the normalized, M-sample epochs, although linear interpolation may also be used.

Next, the Combine Segments step 263 combines the denormalized segments to create a complete excitation waveform estimate. The Combine Segments step 263 inserts each of the excitation segments into an excitation waveform buffer corresponding to the epoch locations derived in the Calculate Epoch Locations step 258, resulting in a complete excitation waveform estimate with smoothly evolving pitch.

The Reconstruct Composite Excitation process then exits in step 268. By employing the Reconstruct Composite Excitation process 216 (FIG. 22), reconstruction of both the primary and secondary excitation epoch components results in higher quality synthesized speech at the receiver.

3. Reconstruct Symmetric Excitation

Given the symmetric excitation characterization produced by the Excitation Pulse Compression Filter process 50 (FIG. 2) and the Characterize Symmetric Excitation process 58 (FIG. 2), a companion process, the Reconstruct Symmetric Excitation process 218 (FIG. 22) reconstructs the symmetric excitation segment and excitation waveform estimate in accordance with an alternate embodiment of the invention.

Figure 27:
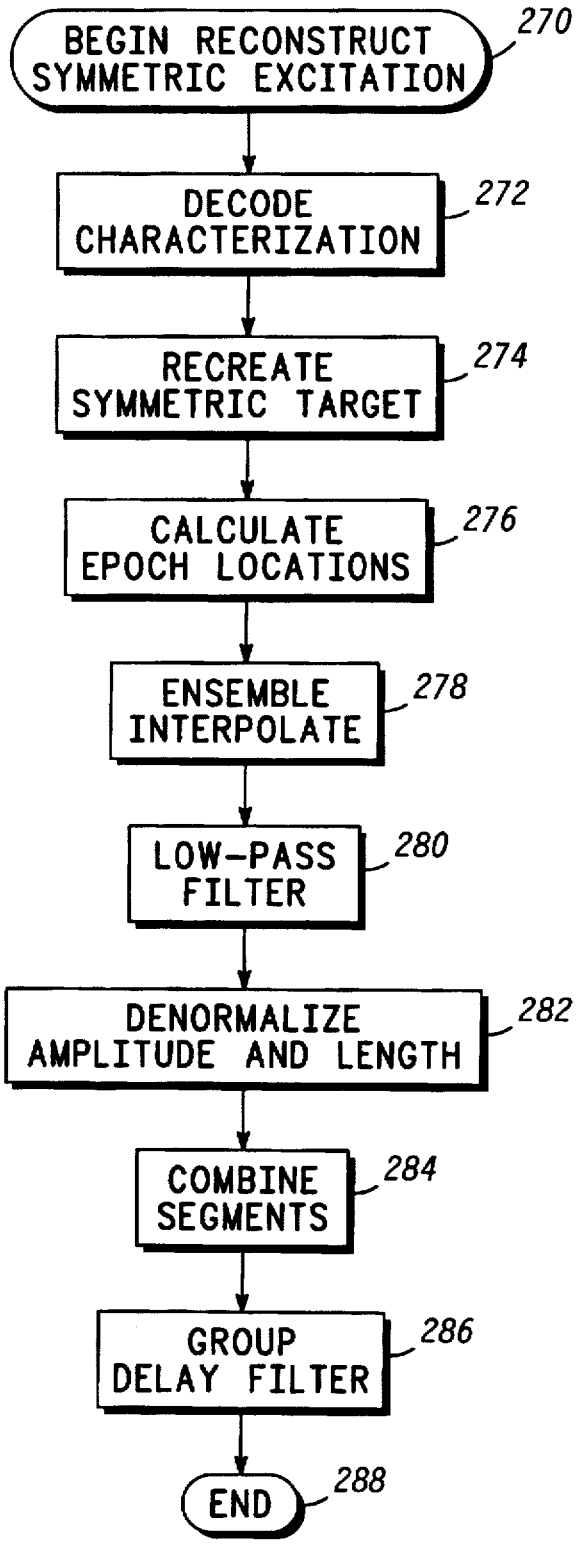
FIG. 27 illustrates a flow chart of a method for reconstructing the symmetric excitation waveform in accordance with an alternate embodiment of the present invention.

FIG. 27 illustrates a flow chart of a method for reconstructing the symmetric excitation waveform in accordance with an alternate embodiment of the present invention. The Reconstruct Symmetric Excitation process begins in step 270 with the Decode Characterization step 272, which generates characterizing excitation values using a companion VQ codebook to the Encode Characterization step 182

(FIG. 11) or 206 (FIG. 20). As would be obvious to one of skill in the art based on the description, the Decode Characterization step 272 may be omitted if this step has been performed by the Synthesis Pre-Processing step 214 (FIG. 22).

After decoding of the excitation characterization data, the Recreate Symmetric Target step 274 creates a symmetric target (e.g., target 200, FIG. 19) by mirroring the decoded excitation target vector about the peak axis. This recreates a symmetric, length and amplitude normalized target of M samples, where M is desirably equal to twice the decoded excitation vector length in samples, minus one.

Next, the Calculate Epoch Locations step 276 calculates the intervening number of epochs, N, and corresponding epoch positions based upon prior frame target location, current frame target location, prior frame target pitch, and current frame target pitch. Current frame target location corresponds to the target location estimate derived in a preferred, closed-loop embodiment employed at analysis device 10 (FIG. 1). Locations are computed so as to ensure a smooth pitch evolution from the prior target, or source, to the current target, as would be obvious to one of skill in the art based on the description. The result of the Calculate Epoch Locations step 276 is an array of epoch locations spanning the current excitation segment being reconstructed.

Next, the Ensemble Interpolate step 278 is performed which reconstructs a synthesized excitation waveform by interpolating between multiple symmetric targets within a synthesis block. Given the symmetric, normalized target reconstructed in the previous step and a corresponding target in an adjacent frame, the Ensemble Interpolate step 278 reconstructs N intervening epochs between the two targets, where N is derived in the Calculate Epoch Locations step 276. Because the length and amplitude normalized, symmetric, match-filtered epochs are already optimally positioned for ensemble interpolation, prior-art correlation methods used to align epochs are unnecessary in this embodiment.

The Low-Pass Filter step 280 is then desirably performed on the ensemble interpolated M-sample excitation segments in order to condition the upsampled, interpolated data for subsequent downsampling operations. Low-pass filter cutoff, $f_c$, is desirably selected in an adaptive fashion to accommodate the time-varying downsampling rate defined by the current target pitch value and intermediate pitch values calculated in the Calculate Epoch Locations step 276.

Following the Low Pass Filter step 280, the Denormalize Amplitude and Length step 282 downsamples the normalized, interpolated, low-pass filtered excitation segments to segment lengths corresponding to the epoch locations derived in the Calculate Epoch Locations step 276. In a preferred embodiment, a nonlinear, cubic spline interpolation is used to derive the excitation values from the normalized M-sample epochs, although linear interpolation may also be used. This step produces intervening epochs with an intermediate pitch relative to the reconstructed source and target excitation. The Denormalize Amplitude and Length step 282 also performs amplitude denormalization of the intervening epochs to appropriate relative amplitude or energy levels as derived from the decoded waveform energy parameter. In a preferred embodiment, energy is interpolated linearly between synthesis blocks.

Following the Denormalize Amplitude and Length step 282, the denormalized segments are combined to create the complete excitation waveform estimate. The Combine Segments step 284 inserts each of the excitation segments into the excitation waveform buffer corresponding to the epoch locations derived in the Calculate Epoch Locations step 276, resulting in a complete excitation waveform estimate with smoothly evolving pitch.

The Combine Segments step 284 is desirably followed by the Group Delay Filter step 286, which is included as an excitation waveform post-process to further enhance the quality of the synthesized speech waveform. The Group Delay Filter step 286 is desirably an all-pass filter with pre-defined group delay characteristics, either fixed or selected from a family of desired group delay functions. As would be obvious to one of skill in the art based on the description, the group delay filter coefficients may be constant or variable. In a variable group delay embodiment, the filter function is selected based upon codebook mapping into the finite, pre-selected family, such mapping derived at the analysis device from observed group delay behavior and transmitted via codebook index to the synthesis device 24 (FIG. 1).

Figure 28:
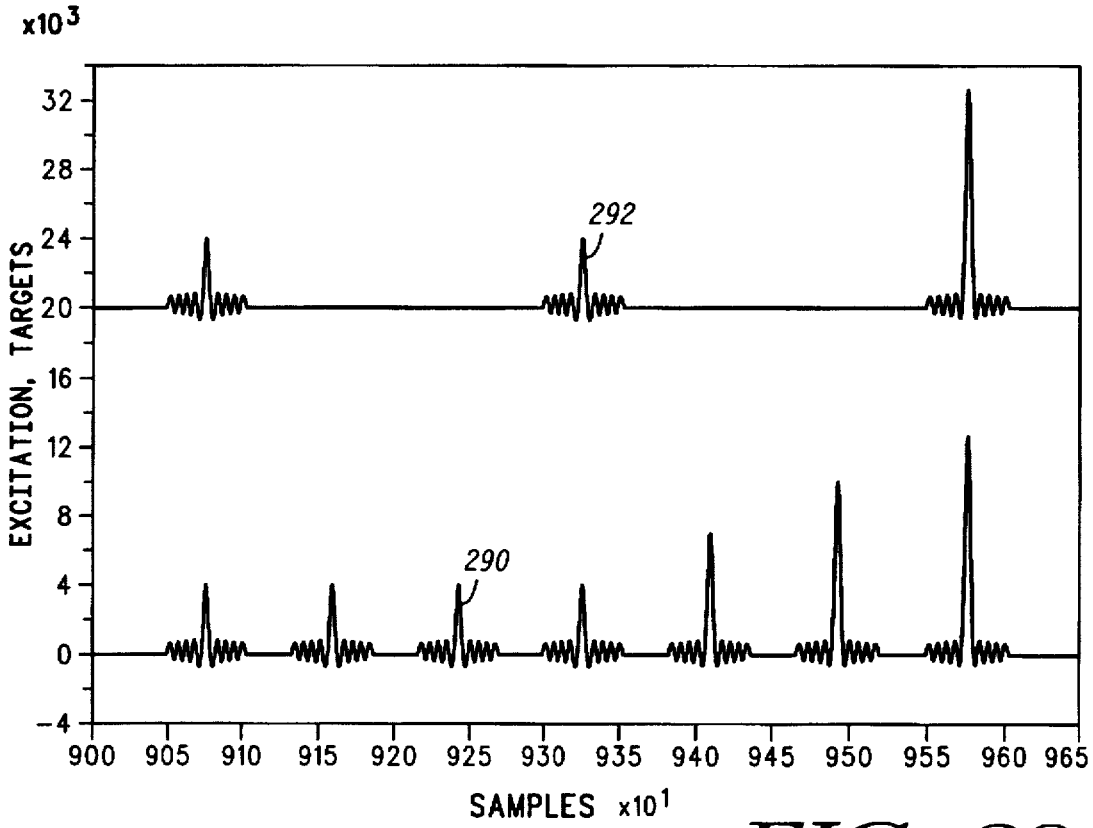
FIG. 28 illustrates a typical excitation waveform reconstructed from excitation pulse compression filtered targets in accordance with an alternate embodiment of the present invention.

The Reconstruct Symmetric Excitation procedure then exits in step 288. FIG. 28 illustrates a typical excitation waveform 290 reconstructed from excitation pulse compression filtered targets 292 in accordance with an alternate embodiment of the present invention.

In summary, this invention provides an improved excitation characterization and reconstruction method that improves upon prior-art excitation modeling. Vocal excitation models implemented in most reduced-bandwidth vocoder technologies fail to reproduce the full character and resonance of the original speech, and are thus unacceptable for systems requiring high-quality voice communications.

The novel method is applicable for implementation in a variety of new and existing voice coding platforms that require more efficient, accurate excitation modeling algorithms. Generally, the excitation modeling techniques may be used to achieve high voice quality when used in an appropriate excitation-based vocoder architecture. Military voice coding applications and commercial demand for high-capacity telecommunications indicate a growing requirement for speech coding techniques that require less bandwidth while maintaining high levels of speech fidelity. The method of the present invention responds to these demands by facilitating high quality speech synthesis at the lowest possible bit rates.

Thus, an improved method and apparatus for characterization and reconstruction of speech excitation waveforms has been described which overcomes specific problems and accomplishes certain advantages relative to prior-art methods and mechanisms. The improvements over known technology are significant. Voice quality at low bit rates is enhanced.

While a preferred embodiment has been described in terms of a telecommunications system and method, those of skill in the art will understand based on the description that the apparatus and method of the present invention are not limited to communications networks but apply equally well to other types of systems where compression of voice or other signals is important.

It is to be understood that the phraseology or terminology employed herein is for the purpose of description and not of limitation. Accordingly, the invention is intended to embrace all such alternatives, modifications, equivalents and variations as fall within the spirit and broad scope of the appended claims.

What is claimed is:

1. A method of encoding speech comprising the steps of:

a) receiving analog voice signals representing the speech, b) performing an analog-to-digital conversion on the analog voice signals, resulting in a plurality of digital excitation samples:

c) selecting an analysis block of excitation from the plurality of digital excitation samples;

d) generating excitation phase data for the analysis block;

e) generating dealiased excitation phase data from the excitation phase data by first-pass phase dealiasing the analysis block;

f) computing a derivative of the dealiased excitation phase data;

g) identifying, from the derivative, discontinuity samples whose magnitudes exceed a predetermined deviation error;

h) identifying consistent discontinuity samples and inconsistent discontinuity samples, where the inconsistent discontinuity samples are identified as the discontinuity samples where a first slope direction is different from a second slope direction corresponding to each of the discontinuity samples;

i) generating twice dealiased excitation phase data by second-pass phase dealiasing the dealiased excitation phase data corresponding to the inconsistent discontinuity samples;

j) encoding data representative of the twice dealiased excitation phase data; and k) storing a bitstream that incorporates the data.

2. The method as claimed in claim 1, wherein step g) comprises the steps of:

g1) computing a reference value corresponding to the derivative; and g2) identifying, from the derivative, the discontinuity samples having the magnitudes exceeding the predetermined deviation error, where the predetermined deviation error is a predetermined multiple of the reference value.

3. The method as claimed in claim 2, wherein step g1) comprises computing the reference value as equal to a standard deviation of the derivative.

4. The method as claimed in claim 1, wherein step h) comprises the step of identifying the first slope direction as a slope direction corresponding to multiple phase samples preceding each of the discontinuity samples.

5. The method as claimed in claim 1, wherein step h) comprises the step of identifying the first slope direction as a slope direction corresponding to multiple phase samples following each of the discontinuity samples.

6. The method as claimed in claim 1, further comprising the step of transmitting the bitstream.

7. A speech vocoder analysis device comprising:

an analog-to-digital converter for converting input speech signals into digital speech samples; and an analysis processor coupled to the analog-to-digital converter for generating excitation phase data for an analysis block of excitation selected from the digital speech samples, generating dealiased excitation phase data from the excitation phase data by first-pass phase dealiasing the analysis block, computing a derivative of the dealiased excitation phase data, identifying, from the derivative, discontinuity samples whose magnitudes exceed a predetermined deviation error, identifying consistent discontinuity samples and inconsistent discontinuity samples, where the inconsistent discontinuity samples are identified as the discontinuity samples where a first slope direction is different from a second slope direction corresponding to each of the discontinuity samples, generating twice dealiased excitation phase data by second-pass phase dealiasing the dealiased excitation phase data corresponding to the inconsistent discontinuity samples, and encoding data representative of the twice dealiased excitation phase data.

* * * * *